US005472837A

United States Patent [19]

Okutsu

[11] Patent Number: 5,472,837

[45] Date of Patent: Dec. 5, 1995

[54] SILVER HALIDE EMULSION AND METHOD OF PREPARING THE SAME

[75] Inventor: Tetsuo Okutsu, Minami-ashigara, Japan

[73] Assignee: Fuji Photo Film Co., Ltd., Kanagawa, Japan

[21] Appl. No.: 189,733

[22] Filed: Feb. 1, 1994

[30] Foreign Application Priority Data

Feb. 2, 1993 [JP] Japan ..... 5-036213

[51] Int. Cl.[6] ..... G03C 1/015

[52] U.S. Cl. ..... 430/569; 430/567

[58] Field of Search ..... 430/567, 569

[56] References Cited

U.S. PATENT DOCUMENTS

| | | | |
|---|---|---|---|
| 4,879,208 | 11/1989 | Urabe et al. | 430/567 |
| 4,977,074 | 12/1990 | Saitou et al. | 430/567 |
| 5,147,771 | 9/1992 | Tsaur et al. | 430/567 |
| 5,250,403 | 10/1993 | Antoniades et al. | 430/567 |

FOREIGN PATENT DOCUMENTS

| | | |
|---|---|---|
| 507701 | 10/1992 | European Pat. Off. . |
| 514742 | 11/1992 | European Pat. Off. . |
| 513722 | 11/1992 | European Pat. Off. . |

*Primary Examiner*—Janet C. Baxter

*Attorney, Agent, or Firm*—Birch, Stewart, Kolasch & Birch

[57] ABSTRACT

A silver halide emulsion comprising 50% to 100% of projected area of all silver halide grains are occupied by hexagonal tabular silver halide grains which have an aspect ratio of 8 to 40, which have a ratio of the longest side to the shortest side of 1 to 2, and which have an average silver iodide content of 2 mol % to 10 mol %, and all silver halide grains have a grain size of variation coefficient of 8% to 20%. A method of preparing the emulsion described above, comprising a nucleation step and a grain-growing step and in which a dispersant used in the nucleation step is low-molecular gelatin having a molecular weight of 5,000 to 25,000, and nucleation time t (seconds) in the nucleation step satisfies the relationship of $1<t<-T+90$, where T (°C.) is a temperature of a reaction vessel at the time of the nucleation step.

10 Claims, No Drawings

SILVER HALIDE EMULSION AND METHOD OF PREPARING THE SAME

BACKGROUND OF THE INVENTION

1. Field of the Invention

The present invention relates to a tabular silver halide emulsion which is useful in the field of photography, and also to a method of preparing the same.

2. Description of the Related Art

Tabular silver halide grains having parallel twin planes (hereinafter referred to as "tabular grains") have the following photographic properties:

1) Since they have a large ratio of the surface area to the volume (hereinafter called "specific surface area"), a great amount of a sensitizing dye can be adsorbed to their surface. As a result, they have color sensitized-sensitivity which is high relative to their intrinsic sensitivity.

2) When an emulsion containing the tabular grains is coated and dried, the planes of the grains are arranged in parallel on the surface of a support, whereby the coated layer can be so thin that sharpness is good.

3) In the case of same sensitivity, the amount of silver coated can be smaller than in the case of using a non-tabular grain emulsion, and the sensitivity/graininess ratio is therefore high.

4) They are highly resistant to natural radiation.

Having these many advantages, the tabular grains have hitherto been used in commercially available materials.

An ideal feature which tabular grains must have to demonstrate their advantages fully is high aspect ratio. Tabular grains having a high aspect ratio, however, will have the following defects if prepared by the known method.

1) They have a broad distribution of diameter of projected area.

2) The tabular grains exist along with bar-shaped ones, tetrapod-shaped ones, ones having single twinning, or ones having non-parallel twin planes.

3) Hexagonal tabular AgX grains (hereinafter called "hexagonal tabular grains") and triangular tabular AgX grains (hereinafter called "triangular tabular grains") exist together as the tabular grains.

Therefore, the tabular grains are disadvantageous in the following respects:

1) They cannot be expected to achieve hard gradation (i.e., so-called high gamma) in a characteristic curve.

2) When they consist of large ones and small ones, optimal chemical sensitization cannot be performed on them since the best conditions for chemical sensitization of the large ones differ from those for chemical sensitization of the small ones.

3) Since hexagonal tabular grains and triangular tabular grains exist together, they have non-uniform chemical-sensitization characteristic since these types of grains differ in chemical sensitization readiness.

4) The portion of the largest diameter of a hexagonal tabular grain has 1.23 times greater than that of the largest diameter of a triangular tabular gain having the same projected area. Hence, triangular tabular gains, if existing along with hexagonal ones, will deteriorate graininess.

5) A multi-layered structure which has an upper layer formed of monodisperse large grains and a lower layer formed of monodisperse small grains utilizes light more efficiently and hence has higher sensitivity than a single layered structure which has an emulsion coating layer which contains large grains and small grains together. This advantage cannot be utilized well.

Generally, tabular gains are formed in three steps, i.e., nucleation, ripening, and grain growth. Since it is impossible to form only tabular grains in the nucleation step, the grains other than the tabular ones must be eliminated in the ripening step. The monodispersibility of the tabular grains is determined during the nucleation and ripening steps. In the method of preparing tabular grains having a low aspect ratio of 8 or less, solvents for silver halide, representative examples of which are ammonia and thioether, are used to eliminate the grains other than tabular ones and to enhance the monodispersibility of tabular grain nuclei as is disclosed by Saitoh in JP-A-2-838, JP-A-1-1311541, JP-A-2-28638, and JP-A-63-11928. ("JP-A" means Published Unexamined Japanese Patent Application.) A method is disclosed in which ammonia ripening is performed, thereby forming tabular grains which have an average aspect ratio of 5.8 and which have a variation coefficient of 10.5% and thus excel in monodispersibility.

However, it is not desirable that a solvent such as ammonia or thioether be used to dissolve silver halide in the step of forming grains which have a high aspect ratio. This is because, although the solvent eliminates the grains other than tabular ones to enhance the dispersibility among the tabular nuclei, it deforms the tabular nuclei into spherical one or the like. Consequently, each tabular grain becomes thicker, failing to have a high aspect ratio. It would therefore be very difficult to form tabular grains having a high aspect ratio, without using solvents for silver halide, due to the fact that the tabular grains mix with other grains and are broadly distributed in terms of size. No solvents may be used for silver halide, and only physical ripening (known as Ostwald ripening) is performed sufficiently long, thereby to eliminate the grains other than the tabular ones. In this case, however, the ripening of the tabular grain each other is promoted such that small tabular grains become smaller and the large grains become larger, inevitably increasing the size distribution among the tabular grains.

With regard to preparation of tabular grains having a high aspect ratio, Zola et al. disclose in JP-A2-222940 a method of preparing silver iodobromide grains which exhibit monodispersibility and which are characterized in that the quotient obtained by dividing the aspect ratio by the variation coefficient is over 0.7. Also, Brust discloses in International Disclosure 92/07295 a method of preparing silver iodobromide grains which exhibit monodispersibility and which are characterized in that the quotient obtained by dividing the aspect ratio by the variation coefficient is over 1.2. Either embodiment, however, does not provide tabular grains which have a variation coefficient of less than 20% and an aspect ratio ranging from 8 to 30 and which are therefore considered useful in monodisperse tabular grain emulsions practically used as photographic emulsions. U.S. Pat. Nos. 5,147,771, 5,147,772 and 5,147,773, all to Tsaur et al., which were recently published, disclose methods of decreasing the size distribution of grains by the use of polymers during the forming of grains. These patents describe method of manufacturing emulsions much excelling in monodispersibility, containing grains which have an aspect ratio of 8 or more and a variation coefficient of less than 10%. However, it is pure silver bromide emulsions which exhibit excellent monodispersibility; none of the silver iodobromide emulsions excelling in photographic properties have an aspect ratio of 8 or more and a variation coefficient of less than 20%. The higher the content of iodide ions, the more difficult it would be to achieve high monodispersibility. In other words, the projected area distribution of the grains greatly broadens as iodide ions increase in number. If the grains are made to contain a high-silver iodide region, the aspect ratio will decrease remarkably as is known in the art. To place a high-silver iodide region within a grain is very desirable for the purpose of improving sensitivity, graininess, and resistance to pressure. The practical importance of silver iodobromide emulsions containing silver iodide and silver iodobromide emulsions having a high-silver iodide region in the grains are well known. Nonetheless, it has been desired that techniques be developed to prepare such an emulsion which has not only a high aspect ratio but also a narrow grain-size distribution.

SUMMARY OF THE INVENTION

The object of the present invention is to provide a silver halide emulsion which has iodobromide grains excelling in sensitivity and graininess, and which utilizes the excellent properties of the grains when used in a multi-layered structure.

The object of the present invention has been attained by the following means:

(1) A silver halide emulsion comprising 50% to 100% of projected area of all silver halide grains are occupied by hexagonal tabular silver halide grains which have an aspect ratio of 8 to 40, which have a ratio of the longest side to the shortest side of 1 to 2, and which have an average silver iodide content of 2 mol % to 10 mol %, and all silver halide grains have a grain size of variation coefficient of 8% to 20%.

(2) The silver halide emulsion described in item (1) above, wherein the silver halide grains contain a high-silver iodide region containing 6 mol % to 20 mol % of silver iodide.

(3) The silver halide emulsion described in item (1) above, wherein 50% to 100% of projected area of all silver halide grains are occupied by silver halide grains having an aspect ratio of 12 to 40.

(4) A method of preparing the emulsion described in item (1) above, comprising a nucleation step and a grain-growing step and in which a dispersant used in the nucleation step is low-molecular gelatin having a molecular weight of 5,000 to 25,000, and nucleation time t (seconds) in the nucleation step satisfies the relationship of $1<t<-T+90$, where T (°C.) is a temperature of a reaction vessel at the time of the nucleation step.

The term "aspect ratio" pertaining to tabular silver halide emulsions means the ratio of the thickness of a tabular silver halide grain to the diameter of the grain. In other words, the aspect ratio is a value obtained by dividing the diameter of the individual silver halide grain by the thickness thereof. The word "diameter," used here, means the diameter of a circle which has an area equal to the projected area of the grain, which is determined through microscope or electron microscope observation. Hence, an aspect ratio of 8 or more means that the diameter of that circuit is 8 or more times greater than the thickness of the grain. The emulsion grains according to the present invention have an aspect ratio of 8 to 40, preferably 12 to 40, and more preferably 15 to 30. Still more preferably, they have an aspect ratio of 18 to 30. If the aspect ratio is too high, pressure marks and the like will occur. On the other hand, if the aspect ratio is too low, the excellent properties of the tabular grain emulsion will be diminished.

An example of methods of measuring the aspect ratio is replica method in which the equivalent-circle diameter and thickness of each grain are detected from the photograph of that grain which has been taken by a transmission electron microscope. In this method, the tackiness is calculated from the length of the shadow of an replica.

The tabular grains used in the present invention are hexagonal. "Hexagonal tabular grains" are those which are hexagonal in their major plane and have an adjacent side ratio (the longest side/the shortest side) ranging from 1 to 2. The adjacent side ratio is preferably 1 to 1.6, more preferably 1 to 1.2. Tabular grains having a high aspect ratio includes a large number of triangular tabular grains. Triangular tabular grains are formed in the case where Ostwald ripening has proceeded extremely. Thus it is necessary to shorten the ripening time as much as possible. To this end, it is required that nucleation be performed to increase the ratio of tabular grains.

The variation coefficient of grain size is a value obtained by dividing the standard deviation of the equivalent-circle diameters of projected areas of all silver halide grains, by the average diameter of the silver halide grains. In the present invention, the variation coefficient of grain size is 8% to 20%, preferably 8% to 17%, more preferably 8% to 15%.

The tabular silver halide grains used in the present invention are made of either silver iodobromide or silver iodochlorobromide, and have an average content of silver iodide which is 2% to 10% (mol %), preferably 3% to 10%, and more preferably 4% to 10%.

The tabular grains in the silver halide emulsion of the present invention may internally have at least two regions or layers having uniform halogen composition or substantially different halogen compositions. Preferably, they have two or more layers. The high-silver iodide region has a portion containing preferably 6% to 20% of silver iodide, more preferably 8% to 20% of silver iodide. The content of iodide ions in the high-silver iodide region of the grain can be measured by an analytical electron microscope using a transmission electron microscope. When the electron beam used in the transmission electron microscope is applied onto the silver halide grain, the electrons causes inelastic scattering within the sample, thereby generating characteristic X-rays. The characteristic X-rays have values specific to the elements forming the sample. Hence, these X-rays conveys the information on the element composition of the sample. As is known, the grain, when exposed to blue light, has its intrinsic sensitivity increased in proportion to the content of silver iodide, and when spectrally sensitized, absorbs more cyanine dye to be more thoroughly coated with a sensitizing dye. Also known is that the $I^-$ released during processing inhibits the development, ultimately improving the graininess.

The hexagonal tabular grains obtained by the present invention are formed in the steps of nucleation, Ostwald ripening and grain growth. Each of these steps is important, serving to prevent the grain-size distribution from expanding. The grain-size distribution, once broadened in a step, can no longer be narrowed in any following step. Therefore, some measures must be taken not to allow the size distribution to expand in the initial step of nucleation. An important point with the nucleation is the relationship between the nucleation time and the temperature of the reaction solution used, said nucleation time being a period which elapses from the time when silver ions and bromide ions are added to the reaction solution by double-jet method to the time when precipitation is formed in the solution. In JP-A-63-92942, Saitoh describes that the temperature of the reaction solution should better be at 20° to 45° C. during nucleation, in order to improve the monodispersibility. In JP-A-2-222940, Zola et al. teach that a desirable temperature for nucleation is 60° C. or less.

In the present invention, the time required for the nucleation may be defined by using a function of temperature, to thereby demonstrate that tabular grains having both a high monodispersibility and a high aspect ratio can be formed in any temperature range that can be practically chosen easily. When a silver nitrate aqueous solution and a potassium bromate aqueous solution are added to the reaction solution, silver halide will precipitate immediately. The tiny silver halide grains formed increase in number as silver ions and bromide ions are added, but not in proportion to time. The number of silver halide grains increases gradually less and finally stops increasing upon reaching a specific value. The silver halide fine grains, thus precipitated, start growing as soon as they have been formed. The earlier a grain has been formed, the more readily it grows. The later a grain has been formed, the less readily it grows. If the nuclei being formed differ from one another in terms of size, the size difference will be amplified in the Ostwald ripening performed later. The expansion of the nucleus-size distribution, occurring during the nucleation, is determined by the nucleation time and the temperature of the reaction solution. It is important to perform the nucleation for 60 seconds or less at the temperature of 30° C., for 30 seconds or less at the temperature of 60° C., and for 15 seconds or less at the temperature of 75° C. The period upon lapse of which the size distribution starts expanding depends on the temperature at the nucleation. This is because the tiny silver halide grains have dissolved. By completing the nucleation within this period, tabular grains having a high aspect ratio can be formed in any feasible temperature range, without detriment to the monodispersibility. In the present invention, the relationship between the nucleation time t (second) and the temperature T (°C.) of a reaction vessel at the nucleation is $1<t<-T+90$. The time-temperature relationship is preferably $1<t<-T+60$, more preferably $1<t<-T+50$. In practice, T is 5° C. to 85° C., preferably 20° C. to 60° C., more preferably 20° C. to 45° C.

The object of the present invention is to form tabular grains having a high aspect ratio. This resides in providing a method of forming nuclei including but a small number of non-tabular grains. A method, which seems effective in forming such nuclei, is disclosed by Saitoh in JP-A-1-158426. This method uses gelatin having an average molecular weight of 70,000 or less in nucleation. In Saltoh's method, the grains other than tabular ones are eliminated after the nucleation by the use of a solvent for silver halide. No silver halide solvent can be used in the present invention, which aims at forming tabular grains having a high aspect ratio. with the present invention nucleation must be performed to form tabular grains at a high ratio. In the present invention it is therefore important to utilize a dispersant which helps to form tabular grains at a high rate. The low-molecular gelatin for use in the present invention is one having a molecular weight of 5,000 to 25,000. Preferably it has a molecular weight ranging 5,000 to 20,000. More preferably, it has a molecular weight ranging from 5,000 to 18,000.

Two nucleation methods are known, i.e., single-jet method and double-jet method. The single-jet method is to add a silver nitrate aqueous solution to an aqueous solution of halide salt. The double-jet method is to add together a silver nitrate aqueous solution and an aqueous solution of halide salt. The double-jet method is preferred, in which the supersaturation within the stirring-mixing vessel is high and nuclei can readily be formed, is preferable. This is because, in the present invention, the nucleation must be so performed as to form twinning nuclei at a high rate.

The nucleation can be conducted in the range of 20° C. to 60° C. Nevertheless, it is desirable that it be performed in the range of 30° C. to 60° C., in view of a desired high ratio of twinning nuclei and manufacture feasibility. After the post-nucleation temperature rise, pAg is adjusted to 7.6 to 10.0, eliminating the grains other than the tabular ones. Only tabular grains, thus obtained, are made to grow, thereby forming tabular seed-crystal grains as desired. In the grain-growing step it is desirable to add silver and a halogen solution so that no new crystal nuclei may be formed. The aspect ratio of the emulsion grains can be controlled by selecting a proper grain-growing temperature, an appropriate pAg value, and a suitable rate of adding together the silver nitrate aqueous solution and the aqueous solution of halide salt.

Part or all of the silver added in the grain-growing step may be supplied in the form of fine grains of silver halide, as is described in JP-A-62-99751.

It is preferable to wash an emulsion of the present invention with water, to thereby form a newly prepared protective colloid dispersion for a desalting purpose. Although the temperature for the washing can be selected in accordance with the intended use, it is preferably 5° C. to 50° C. Although the pH for the washing can also be selected in accordance with the intended use, it is preferably 2 to 10, and more preferably 3 to 8. The value of pAg for the washing is preferably 5 to 10, though it can also be selected in accordance with the intended use. The washing method can be selected from noodle washing, dialysis using a semipermeable membrane, centrifugal separation, coagulation precipitation, and ion exchange. The coagulation precipitation can be selected from a method using sulfate, a method using an organic solvent, a method using a water-soluble polymer, and a method using a gelatin derivative.

In the preparation of an emulsion according to the present invention, it is preferable to let salt of metal ion be present during the forming of grains, desalting, or chemical sensitization, or before coating, in accordance with the intended use. The salt of metal ion is preferably added during the forming of grains in order to be doped into the grains. The salt should be added after the forming of grains and before the completion of the chemical sensitization, in order to modify the grain surface or to chemically sensitize the grains. The salt may be doped into each grain entirely, the core thereof, the shell thereof, the epitaxial portion thereof, or the substrate grain only. Examples of the metal are Mg, Ca, Sr, Ba, Al, Sc, Y, La, Cr, Mn, Fe, Co, Ni, Cu, Zn, Ga, Ru, Rh, Pd, Re, Os, Ir, Pt, Au, Cd, Hg, Tl, In, Sn, Pb, and Bi. These metals can be added in the form of salt which can be dissolved during the forming of grains, such as ammonium salt, acetate, nitrate, sulfate, phosphate, hydroacid salt, 6-coordinated complex salt, or 4-coordinated complex slat. Examples of these salts are: $CdBr_2$, $CdCl_2$, $Cd(NO_3)_2$, $Pb(NO_3)_2$, $Pb(CH_3COO)_2$, $K_3[Fe(CN)_6]$, $(NH_4)_4[Fe(CN)_6]$, $K_3IrCl_6$, $(NH_4)_3RhCl_6$, and $K_4Ru(CN)_6$. A ligand for the coordination compound can be selected from halo, aquo, cyano, cyanate, thiocynate, nitrosyl, thionitrocyl, oxo, and carbonyl. These metal compounds can be used either singly or in combination of two or more types of them.

Preferably the metal compound is dissolved in water or an appropriate organic solvent, such as methanol or acetone, and then added to the solution. To stabilize the solution, a method may be employed in which an aqueous solution of halogenated hydrogen (e.g., HCl or HBr) or alkali halide (e.g., KCl, NaCl, KBr, or NaBr) is added. If necessary, an acid or an alkali can be added. The metal compound may be added into the reaction vessel, either before or during the forming of grains. Alternatively, the metal compound may be added to an aqueous solution of either water-soluble silver salt (e.g., $AgNO_3$) or alkali halide (NaCl, KBr or KI), continuously during the forming of silver halide grains. Furthermore, a solution of the metal compounds can be prepared independently of a water-soluble silver salt or an alkali halide and be added continuously at a proper timing during the forming of grains. Moreover, various addition methods may be used in a combination.

In some cases it is useful to perform a method of adding a chalcogen compound during the preparation of an emulsion, as is described in U.S. Pat. No. 3,772,031. In addition to S, Se and Te, cyanate, thiocyanate, selenocyanate, carbonate, phosphate, or acetate can be present.

The silver halide grains of the present invention may be subjected to at least one of sensitizations such as sulfur sensitization, selenium sensitization, gold sensitization, palladium sensitization or noble metal sensitization, and reduction sensitization, at any given step in the manufacture of the silver halide emulsion. Preferably, two or more sensitizations may be performed in combination. Various types of emulsions can be prepared by changing the timing of performing the chemical sensitization. The emulsion may be of such a type wherein a chemical sensitization speck is embedded within each grain, a type wherein the speck is at a shallow position from the surface of each grain, or a type wherein the speck is formed on the surface of each grain. In the emulsions of the present invention, the location of the chemical sensitization speck can be selected in accordance with the use of the emulsion. However, it is generally desirable to form at least one type of a chemical sensitization speck near the near-surface region of the grain.

One of the chemical sensitizations which can be suitably practiced in the present invention is chalcogen sensitization, noble metal sensitization, or both employed in combination. The chemical sensitization can be performed by using active gelatin, as is described in T. H. James et al., "The Theory of the Photographic Process," 4th ed., pp. 67–76, Macmillan (1977). Also, the chemical sensitization can be achieved with sulfur, selenium, tellurium, gold, platinum, palladium, iridium, or a combination of two or more of these sensitizers, at aAg value of 5 to 10, pH value of 5 to 8, and at 30° to 80° C., as is described in Research Disclosure No. 12008, Vol. 120, April 1974, and Research Disclosure No. 13452, Vol. 34, June 1975, U.S. Pat. Nos. 2,642,361, 3,297,446, 3,772,031, 3,857,711, 3,901,714, 4,266,018, and 3,904,415, and British Patent 1,315,755. In the case of noble metal sensitization, a noble metal salt, such as gold, platinum, palladium or iridium, can be used. Of these, gold sensitization, palladium sensitization, or a combination thereof is particularly preferred. In the gold sensitization, use can be made of a know compound such as chloroauric acid, potassium chloroaurate, potassium aurithiocyanate, gold sulfide, and gold selenide. A palladium compound means either a divalent or tetravalent salt of palladium. A preferable palladium compound is one which is represented as $R_2PdX_6$ or $R_2PdX_4$, where R is hydrogen atom, alkali metal atom, or ammonium group, and X is halogen atom such as chlorine atom, bromine atom or iodine atom.

More specifically, preferably as the palladium compound are: $K_2PdCl_4$, $(NH_4)_2PdCl_6$, $Na_2PdCl_4$, $(NH_4)_2PdCl_4$, $Li_2PdCl_4$, $Na_2PdCl_6$, or $K_2PdBr_4$. The gold compound and the palladium compound preferable be used in combination with thiocyanate or selenocyanate.

In the present invention, it is possible to use hypo-based compounds, thiourea-based compounds, rhodanine-based compounds, and sulfur-containing compounds disclosed in U.S. Pat. Nos. 3,857,711, 4,266,018 and 4,054,457.

It is preferable to perform gold sensitization, too, for emulsions of the present invention. The gold sensitizer is used preferably in an amount of $1\times10^{-4}$ to $1\times10^{-7}$ mole per mole of silver halide, more preferably $1\times10^{-5}$ to $5\times10^{-7}$ mole per mole of silver halide. The palladium compound is used preferably in an amount ranging from $1\times10^{-3}$ to $5\times10^{-7}$ mole per mole of silver halide. The thiocyan compound or the selenocyan compound is used preferably in an amount ranging from $5\times10^{-2}$ to $1\times10^{-6}$ mole per mole of silver halide.

An amount in which use a sulfur sensitizer for the silver halide grains of the present invention is preferably $1\times10^{-4}$ to $1\times10^{-7}$ mole per mole of silver halide, and more preferably $1\times10^{-5}$ to $5\times10^{-7}$ mole per mole of of silver halide.

Selenium sensitization is a preferable sensitizing method for emulsions of the present invention. Known unstable selenium compounds are used in the selenium sensitization. Specific examples of the selenium compound, which can be used, are colloidal metal selenium, selenoureas (e.g. N,N-dimethylselenourea and N,N-diethylselenourea), selenoketones, and selenoamides. In some cases, it is preferable to perform the selenium sensitization in combination with sulfur sensitization or noble metal sensitization, or with both.

The chemical sensitization can also be performed in the presence of a so-called chemical sensitization aid. Useful as a chemical sensitization aid is a compound which is known to suppress fog and increases sensitivity of the grains during the chemical sensitization, such as azaindine, azapyridazine, or azapyrimidine. Examples of the chemical sensitization aid are disclosed in U.S. Pat. Nos. 2,131,038, 3,411,914 and 3,554,757, JP-A-58-126526, and G. F. Duffin, "Photographic Emulsion Chemistry," pp. 138–143.

Silver halide emulsions of the present invention are preferably subjected to reduction sensitization during the forming of grains, after the forming of grains and before chemical sensitization, during chemical sensitization, or after chemical sensitization.

The reduction sensitization can be selected from a method of adding reduction sensitizers to a silver halide emulsion, a method called silver ripening in which grains are grown or ripened in a low-pAg environment at pAg 1 to 7, and a method called high-pH ripening in which grains are grown or ripened in a high-pH environment at pH 8 to 11. It is also possible to perform two or more of these methods together.

The method of adding reduction sensitizers is preferable in that the level of reduction sensitization can be minutely adjusted.

Known examples of the reduction sensitizer are stannous chloride, ascorbic acid and its derivative, amines and polyamines, a hydrazine derivative, formamidinesulfinic acid, a silane compound, and a borane compound. In the reduction sensitization of the present invention, it is possible to selectively use these known reduction sensitizers or to use two or more types of compounds together. Preferable compounds as the reduction sensitizer are stannous chloride, thiourea dioxide, dimethylamineborane, and ascorbic acid and its derivative. Although an addition amount of the reduction sensitizers must be so selected as to meet the emulsion manufacturing conditions, a preferable amount is $10^{-7}$ to $10^{-3}$ mole per mole of a silver halide.

The reduction sensitizers are dissolved in water or an organic solvent, such as alcohols, glycols, ketones, esters, or amides, and the resultant solution is added during grain growth. Although adding to a reactor vessel in advance is also preferable, adding at a given timing during grain growth is more preferable. It is also possible to add the reduction sensitizers to an aqueous solution of a water-soluble silver salt or a water-soluble alkali halide to precipitate silver halide grains by using this aqueous solution. Alternatively, a solution of the reduction sensitizers may be added separately several times or continuously over a long time period with grain growth.

It is preferable to use an oxidizer for silver during the process of manufacturing emulsions of the present invention. The oxidizer for silver means a compound having an effect of converting metal silver into silver ion. A particularly effective compound is the one that converts very fine silver grains, as a by-product in the process of formation of silver halide grains and chemical sensitization, into silver ion. The silver ion thus produced may form a silver salt hardly soluble in water, such as a silver halide, silver sulfide, or silver selenide, or a silver salt readily soluble in water, such as silver nitrate. The oxidizer for silver may be either an inorganic or organic substance. Examples of the inorganic oxidizer are ozone, hydrogen peroxide and its adduct (e.g., $NaBO_2.H_2O_2.3H_2O$, $2NaCO_3.3H_2O_2$, $Na_4P_2O_7.2H_2O_2$, and $2Na_2SO4.H_2O_2.2H_2O$), peroxy acid salt (e.g., $K_2S_2O_8$, $K_2C_2O_6$, and $K_2P_2O_8$), a peroxy complex compound (e.g., $K_2[Ti(O_2)C_2O_4].3H_2O$, $4K_2SO_4.Ti(O_2)OH.SO_4.2H_2O$, and $Na_3[VO(O_2)(C_2H_4)_2].6H_2O$), permanganate (e.g., $KMnO_4$), an oxyacid salt such as chromate (e.g., $K_2Cr_2O_7$), a halogen element such as iodine and bromine, perhalogenate (e.g., potassium periodate), a salt of a high-valence metal (e.g., potassium hexacyanoferrate(II)), and thiosulfonate.

Examples of the organic oxidizer are quinones such as p-quinone, an organic peroxide such as peracetic acid and perbenzoic acid, and a compound which releases active halogen (e.g., N-bromosuccinimide, chloramine T, and chloramine B).

Preferable oxidizers of the present invention are ozone, hydrogen peroxide and its adduct, a halogen element, or an inorganic oxidizer such as a thiosulfonate salt, and an organic oxidizer such as quinones. A combination of the reduction sensitization described above and the oxidizer for silver is preferable. In this case, the reduction sensitization may be performed after the oxidizer is used or vice versa, or the reduction sensitization and the use of the oxidizer may be performed at the same time. These methods can be selectively performed during grain formation or chemical sensitization.

Photographic emulsions used in the present invention may contain various compounds in order to prevent fog during the manufacturing process, storage, or photographic processing of a light-sensitive material, or to stabilize photographic properties. Usable compounds are those known as an antifoggant or a stabilizer, for example, thiazoles, such as benzothiazolium salt, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, and mercaptotetrazoles (particularly 1-phenyl-5-mercaptotetrazole); mercaptopyrimidines; mercaptotriazines; a thioketo compound such as oxadolinethione; azaindenes, such as triazaindenes, tetrazaindenes (particularly hydroxy-substituted(1,3,3a,7)tetrazaindenes), and pentazaindenes. For example, compounds described in U.S. Pat. Nos. 3,954,474 and 3,982,947 and JP-B-52-28660 can be used. One preferable compound is described in JP-A-63-212932. Antifoggants and stabilizers can be added at any of several different timings, such as before, during, and after grain formation, during washing with water, during dispersion after the washing, before, during, and after chemical sensitization, and before coating, in accordance with the intended application. The antifoggants and the stabilizers can be added during preparation of an emulsion to achieve their original fog preventing effect and stabilizing effect. In addition, the antifoggants and the stabilizers can be used for various purposes of, e.g., controlling crystal habit of grains, decreasing a grain size, decreasing the solubility of grains, controlling chemical sensitization, and controlling an arrangement of dyes.

Photographic emulsions used in the present invention are preferably subjected to spectral sensitization by methine dyes and the like, in order to achieve the effects of the present invention. Usable dyes involve a cyanine dye, a merocyanine dye, a composite cyanine dye, a composite merocyanine dye, a holopolar cyanine dye, a hemicyanine dye, a styryl dye, and a hemioxonole dye. Most useful dyes are those belonging to a cyanine dye, a merocyanine dye, and a composite merocyanine dye. Any nucleus commonly used as a basic heterocyclic nucleus in cyanine dyes can be applied to these dyes. Examples of an applicable nucleus are a pyrroline nucleus, an oxazoline nucleus, a thiozoline nucleus, a pyrrole nucleus, an oxazole nucleus, a thiazole nucleus, a selenazole nucleus, an imidazole nucleus, a tetrazole nucleus, and a pyridine nucleus; a nucleus in which an aliphatic hydrocarbon ring is fused to any of the above nuclei; and a nucleus in which an aromatic hydrocarbon ring is fused to any of the above nuclei, e.g., an indolenine nucleus, a benzindolenine nucleus, an indole nucleus, a benzoxazole nucleus, a naphthoxazole nucleus, a benzthiazole nucleus, a naphthothiazole nucleus, a benzoselenazole nucleus, a benzimidazole nucleus, and a quinoline nucleus. These nuclei may have a substitute on a carbon atom.

It is possible for a merocyanine dye or a composite merocyanine dye to have a 5- or 6-membered heterocyclic nucleus as a nucleus having a ketomethylene structure. Examples are a pyrazoline-5-one nucleus, a thiohydantoin nucleus, a 2-thiooxazolidine-2,4-dione nucleus, a thiazolidine-2,4-dione nucleus, a rhodanine nucleus, and a thiobarbituric acid nucleus.

Although these sensitizing dyes may be used singly, they can also be used together. The combination of sensitizing dyes is often used for a supersensitization purpose. Representative examples of the combination are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862, and 4,026,707, British Patents 1,344,281 and 1,507,803, JP-B-43-4936, JP-B-53-12375, JP-A-52-110618, and JP-A-52-109925.

The emulsions used in the present invention may contain, in addition to the sensitizing dyes, dyes having no spectral sensitizing effect or substances not essentially absorbing visible light and presenting supersensitization.

The sensitizing dyes can be added to an emulsion at any point in preparation of an emulsion, which is conventionally known to be useful. Most ordinarily, the addition is performed after completion of chemical sensitization and before coating. However, it is possible to perform the addition at the same time as addition of chemical sensitizing dyes to perform spectral sensitization and chemical sensitization simultaneously, as described in U.S. Pat. Nos. 3,628,969 and 4,225,666. It is also possible to perform the addition prior to chemical sensitization, as described in JP-A-58-113928, or before completion of formation of a silver halide grain precipitation to start spectral sensitization. Alternatively, as disclosed in U.S. Pat. No. 4,225,666, these compounds described above can be added separately; a portion of the compounds may be added prior to chemical sensitization, while the remaining portion is added after that. That is, the compounds can be added at any timing during formation of silver halide grains, including the method disclosed in U.S. Pat. No. 4,183,756.

The addition amount of the spectral sensitizing dye may be $4\times10^{-6}$ to $8\times10^{-3}$ mole per mole of silver halide. However, for a more preferable silver halide grain size of 0.2 to 1.2 μm, an addition amount of about $5\times10^{-5}$ to $2\times10^{-3}$ mole per mole of silver halide is more effective.

Not only the additives described above, but also other additives are used in the light-sensitive material according to the present invention, in accordance to the application of the material.

These additives are described in Research Disclosure Item 17643 (December 1978), Research Disclosure Item 18716 (November 1979), and Research Disclosure Item 308119 (December 1989), as is listed in the following list:

| Additives | RD17643 | RD18716 |
|---|---|---|
| 1. Chemical sensitizers | page 23 | page 648, right column |
| 2. Sensitivity-increasing agent | | ditto |
| 3. Spectral sensitizers, super-sensitizers | pages 23–24 | page 648, right column to page 649, right column |
| 4. Brighteners | page 24 | page 648, right column |
| 5. Antifoggants, stabilizers | pages 24–25 | page 649, right column |
| 6. Light absorbent, filter dye, ultraviolet absorbents | pages 25–26 | page 649, right column to page 650, left column |
| 7. Stain-preventing agents | page 25, right column | page 650, left to right columns |
| 8. Dye image-stabilizer | page 25 | page 650, left column |
| 9. Hardening agents | page 26 | page 651, left column |
| 10. Binder | page 26 | ditto |
| 11. Plasticizers, Lubricants | page 27 | page 650, right column |
| 12. Coating aids, Surface active agents | page 26–27 | ditto |
| 13. Antistatic agents | page 27 | ditto |
| 14. Matting agents | | |

| Additives | RD308119 |
|---|---|
| 1. Chemical sensitizers | Page 996 |
| 2. Sensitivity-increasing agent | |
| 3. Spectral sensitizers, super-sensitizers | page 996, right column to page 998, right column |
| 4. Brighteners | page 998, right column |
| 5. Antifoggants, stabilizers | page 998, right column to page 1,000, right column |
| 6. Light absorbent, filter dye, ultraviolet absorbents | pages 1,003, left column to page 1,003, right column |
| 7. Stain-preventing agents | page 1,002, right column |
| 8. Dye image-stabilizer | page 1,002, right column |
| 9. Hardening agents | page 1,004, right column to page 1,005, left column |
| 10. Binder | page 1,003, right column to page 1,004, right column |
| 11. Plasticizers, Lubricants | page 1,006, left column to page 1,006, right column |
| 12. Coating aids, Surface active agents | page 1,005, left column to page 1,006, left column |
| 13. Antistatic agents | page 1,006, right column to page 1,007, left column |
| 14. Matting agents | page 1,008, left column to page 1,009, left column |

The light-sensitive material of the present invention needs only to have at least one of silver halide emulsion layers, i.e., a blue-sensitive layer, a green-sensitive layer, and a red-sensitive layer, formed on a support. The number or order of the silver halide emulsion layers and the non-light-sensitive layers are particularly not limited. A typical example is a silver halide photographic light-sensitive material having, on a support, at least one light-sensitive layers constituted by a plurality of silver halide emulsion layers which are sensitive to essentially the same color sensitivity but has different sensitivities. The light-sensitive layers are unit light-sensitive layer sensitive to blue, green or red. In a multilayered silver halide color photographic light-sensitive material, the unit light-sensitive layers are generally arranged such that red-, green-, and blue-sensitive layers are formed from a support side in the order named. However, this order may be reversed or a layer sensitive to one color may be sandwiched between layers sensitive to another color in accordance with the application.

Non-light-sensitive layers such as various types of interlayers may be formed between the silver halide light-sensitive layers and as the uppermost layer and the lowermost layer.

The interlayer may contain, e.g., couplers and DIR compounds as described in JP-A-61-43748, JP-A-59-113438, JP-A-59-113440, JP-A-61-20037, and JP-A-61-20038 or a color mixing inhibitor which is normally used.

As a plurality of silver halide emulsion layers constituting each unit light-sensitive layer, a two-layered structure of high- and low-sensitivity emulsion layers can be preferably used as described in West German Patent 1,121,470 or British Patent 923,045. In this case, layers are preferably arranged such that the sensitivity is sequentially decreased toward a support, and a non-light-sensitive layer may be formed between the silver halide emulsion layers. In addition, as described in JP-A-57-112751, JP-A-62-200350, JP-A-62-206541, and JP-A-62-206543, layers may be arranged such that a low-sensitivity emulsion layer is formed remotely from a support and a high-sensitivity layer is formed close to the support.

More specifically, layers may be arranged from the farthest side from a support in an order of low-sensitivity blue-sensitive layer (BL)/high-sensitivity blue-sensitive layer (BH)/high-sensitivity green-sensitive layer (GH)/low-sensitivity green-sensitive layer (GL)/high-sensitivity red-sensitive layer (RH)/low-sensitivity red-sensitive layer (RL), an order of BH/BL/GL/GH/RH/RL, or an order of BH/BL/GH/GL/RL/RH.

In addition, as described in JP-B-55-34932, layers may be arranged from the farthest side from a support in an order of blue-sensitive layer/GH/RH/GL/RL. Furthermore, as described in JP-B-56-25738 and JP-B-62-63936, layers may be arranged from the farthest side from a support in an order of blue-sensitive layer/GL/RL/GH/RH.

As described in JP-B-49-15495, three layers may be arranged such that a silver halide emulsion layer having the highest sensitivity is arranged as an upper layer, a silver halide emulsion layer having sensitivity lower than that of the upper layer is arranged as an interlayer, and a silver halide emulsion layer having sensitivity lower than that of the interlayer is arranged as a lower layer, i.e., three layers having different sensitivities or speeds may be arranged such that the sensitivity is sequentially decreased toward the support. When a layer structure is constituted by three layers having different sensitivities, these layers may be arranged in an order of medium-sensitivity emulsion layer/high-sensitivity emulsion layer/low-sensitivity emulsion layer from the farthest side from a support in a layer sensitive to one color as described in JP-A-59-202464.

Also, an order of, for example, high-sensitivity emulsion layer/low-sensitivity emulsion layer/medium-sensitivity emulsion layer or low-sensitivity emulsion layer/medium-sensitivity emulsion layer/high-sensitivity emulsion layer may be adopted.

Furthermore, the arrangement can be changed as described above even when four or more layers are formed.

As described above, various layer configuration and arrangement can be selected in accordance with the application of the light-sensitive material.

In order to prevent degradation in photographic properties caused by formaldehyde gas, a compound described in U.S. Pat. No. 4,411,987 or 4,435,503, which can react with formaldehyde and fix the same, is preferably added to the light-sensitive material.

The light-sensitive material of the present invention preferably contains a mercapto compound described in U.S. Pat. Nos. 4,740,454 and 4,788,132, JP-A-62-18539, and JP-A-1-283551.

The light-sensitive material of the present invention preferably contains compounds which release, regardless of a developed silver amount produced by the development, a fogging agent, a development accelerator, a silver halide solvent, or precursors thereof, described in JP-A-1-106052.

The light-sensitive material of the present invention preferably contains dyes dispersed by methods described in International Disclosure WO 88/04794 and JP-A-1-502912 or dyes described in European Patent 317,308A, U.S. Pat. No. 4,420,555, and JP-A-1-259358.

Various color couplers can be used in the present invention, and specific examples of these couplers are described in patents described in above-mentioned Research Disclosure (RD), No. 17643, VII-C to VII-G and Research Disclosure No. 307105, VII-C to VII-G.

Preferable examples of a yellow coupler are described in, e.g., U.S. Pat. Nos. 3,933,501, 4,022,620, 4,326,024, 4,401,752, and 4,248,961, JP-B-58-10739, British Patents 1,425,020 and 1,476,760, U.S. Pat. Nos. 3,973,968, 4,314,023, and 4,511,649, and European Patent 249,473A.

Examples of a magenta coupler are preferably 5-pyrazolone and pyrazoloazole compounds, and more preferably, the compounds described in, e.g., U.S. Pat. Nos. 4,310,619 and 4,351,897, European Patent 73,636, U.S. Pat. Nos. 3,061,432 and 3,725,067, Research Disclosure No. 24220 (June 1984), JP-A-60-33552, Research Disclosure No. 24230 (June 1984), JP-A-60-43659, JP-A-61-72238, JP-A-60-35730, JP-A-55-118034, and JP-A-60-185951, U.S. Pat. Nos. 4,500,630, 4,540,654, and 4,556,630, and International Disclosure WO 88/04795.

Examples of a cyan coupler are phenol type and naphthol type couplers. Of these, preferable are those described in, e.g., U.S. Pat. Nos. 4,052,212, 4,146,396, 4,228,233, 4,296,200, 2,369,929, 2,801,171, 2,772,162, 2,895,826, 3,772,002, 3,758,308, 4,343,011, and 4,327,173, West German Laid-open Patent Application 3,329,729, European Patents 121,365A and 249,453A, U.S. Pat. Nos. 3,446,622, 4,333,999, 4,775,616, 4,451,559, 4,427,767, 4,690,889, 4,254,212, and 4,296,199, and JP-A-61-42658.

Typical examples of a polymerized dye-forming coupler are described in U.S. Pat. Nos. 3,451,820, 4,080,221, 4,367,282, 4,409,320, and 4,576,910, British Patent 1,102,137, and European Patent 341,188A.

Preferable examples of a coupler capable of forming colored dyes having proper diffusibility are those described in U.S. Pat. No. 4,366,237, British Patent 2,125,570, European Patent 96,570, and West German Laid-open Patent Application No. 3,234,533.

Preferable examples of a colored coupler for correcting unnecessary absorption of a colored dye are those described in Research Disclosure No. 17643, VII-G, Research Disclosure No. 30715, VII-G, U.S. Pat. No. 4,163,670, JP-B-57-39413, U.S. Pat. Nos. 4,004,929 and 4,138,258, and British Patent 1,146,368. A coupler for correcting unnecessary absorption of a colored dye by a fluorescent dye released upon coupling described in U.S. Pat. No. 4,774,181 or a coupler having a dye precursor group which can react with a developing agent to form a dye as a split-off group described in U.S. Pat. No. 4,777,120 may be preferably used.

Compounds releasing a photographically useful residue upon coupling are preferably used in the present invention. DIR couplers, i.e., couplers releasing a development inhibitor are described in the patents cited in the above-described RD No. 17643, VII-F, RD No. 307105, VII-F, JP-A-57-151944, JP-A-57-154234, JP-A-60-184248, JP-A-63-37346, JP-A-63-37350, and U.S. Pat. Nos. 4,248,962 and 4,782,012.

Preferable examples of a coupler for imagewise releasing a nucleating agent or a development accelerator are preferably those described in British Patents 2,097,140 and 2,131,188, JP-A-59-157638, and 10 JP-A-59-170840. In addition, compounds for releasing a fogging agent, a development accelerator, or a silver halide solvent upon redox reaction with an oxidized form of a developing agent, described in JP-A-60-107029, JP-A-60-252340, JP-A-1-44940, and JP-A-1-45687, can also be preferably used.

Examples of other compounds which can be used in the light-sensitive material of the present invention are competing couplers described in, e.g., U.S. Pat. No. 4,130,427; poly-equivalent couplers described in, e.g., U.S. Pat. Nos. 4,283,472, 4,338,393, and 4,310,618: a DIR redox compound releasing coupler, a DIR coupler releasing coupler, a DIR coupler releasing redox compound, or a DIR redox releasing redox compound described in, e.g., JP-A-60-185950 and JP-A-62-24252; couplers releasing a dye which turns to a colored form after being released described in, e.g., European Patents 173,302A and 313,308A; couplers releasing a bleaching accelerator, described in RD NO. 11449, RD No. 24241, and JP-A-61-201247; a ligand releasing coupler described in, e.g., U.S. Pat. No. 4,553,477; a coupler releasing a leuco dye described in JP-A-63-75747; and a coupler releasing a fluorescent dye described in U.S. Pat. No. 4,774,181.

The couplers for use in the present invention can be introduced into the light-sensitive material by various know dispersion methods.

Examples of a high-boiling organic solvent to be used in the oil-in-water dispersion method are described in e.g. U.S. Pat. No. 2,322,027.

Examples of a high-boiling organic solvent to be used in the oil-in-water dispersion method and having a boiling point of 175° C. or more at atmospheric pressure are phthalate esters (e.g., dibutylphthalate, dicyclohexylphthalate, di-2-ethylhexylphthalate, decylphthalate, bis(2,4-di-t-amylphenyl) phthalate, bis(2,4-di-t-amylphenyl) isophthalate, bis(1,1-di-ethylpropyl) phthalate); phosphate or phosphonate esters (e.g., triphenylphosphate, tricresylphosphate, 2-ethylhexyldiphenylphosphate, tricyclohexylphosphate, tri-2-ethylhexylphosphate, tridodecylphosphate, tributoxyethylphosphate, trichloropropylphosphate, and di-2-ethylhexylphenylphosphonate); benzoate esters (e.g., 2-ethylhexylbenzoate, dodecylbenzoate, and 2-ethylhexyl-p-hydroxybenzoate); amides (e.g., N,N-diethyldodecaneamide, N,N-diethyllaurylamide, and N-tetradecylpyrrolidone); alcohols or phenols (e.g., isostearylalcohol and 2,4-di-tert-amylphenol), aliphatic carboxylate esters (e.g., bis(2-ethylhexyl) sebacate, dioctylazelate, glyceroltributylate, isostearyllactate, and trioctylcitrate); aniline derivative (e.g., N,N-dibutyl-2-butoxy-5-tert-octylaniline); and hydrocarbons (e.g., paraffin, dodecylbenzene, and diisopropylnaphthalene). An organic solvent having a boiling point of about 30° C. or more, and preferably, 50° C. to about 160° C. can be used as an auxiliary solvent. Typical examples of the auxiliary solvent are ethyl acetate, butyl acetate, ethyl propionate, methylethylketone, cyclohexanone, 2-ethoxyethylacetate, and dimethylformamide.

Steps and effects of a latex dispersion method and examples of an immersing latex are described in, e.g., U.S. Pat. No. 4,199,363 and German Laid-open Patent Application (OLS) Nos. 2,541,274 and 2,541,230.

Various types of antiseptics and fungicides agent are preferably added to the color light-sensitive material of the present invention. Examples of the antiseptics and the fungicides are phenetyl alcohol, and 1,2-benzisothiazoline-3-one, n-butyl-p-hydroxybenzoate, phenol, 4-chloro-3,5-dimethylphenol, 2-phenoxyethanol, and 2-(4-thiazolyl) benzimidazole described in JP-A-63-257747, JP-A-62-272248, and JP-A-1-80941.

The present invention can be applied to various color light-sensitive materials. Examples of the material are a color negative film for a general purpose or a movie, a color reversal film for a slide or a television, color paper, a color positive film, and color reversal paper.

A support which can be suitably used in the present invention is described in, e.g., RD No. 17643, page 28, RD No. 18716, from the right column, page 647 to the left column, page 648, and RD No. 307105, page 879.

The light-sensitive material of the present invention, the sum total of film thicknesses of all hydrophilic colloidal layers at the side having emulsion layers is preferably 28 μm or less, more preferably, 23 μm or less, much more preferably, 18 μm or less, and most preferably, 16 μm or less. A film swell speed $T_{1/2}$ is preferably 30 sec. or less, and more preferably, 20 sec. or less. The film thickness means a film thickness measured under moisture conditioning at a temperature of 25° C. and a relative humidity of 55% (two day). The film swell speed $T_{1/2}$ can be measured in accordance with a known method in the art. For example, the film swell speed $T_{1/2}$ can be measured by using a swell meter described by Green et al. in "Photographic Science & Engineering," Vol. 19, No. 2, pp. 124 to 129. When 90% of a maximum swell film thickness reached by performing a treatment by using a color developing agent at 30° C. for 3 min. and 15 sec. is defined as a saturated film thickness, $T_{1/2}$ is defined as a time required for reaching ½ of the saturated film thickness.

The film swell speed $T_{1/2}$ can be adjusted by adding a film hardening agent to gelatin as a binder or changing aging conditions after coating. A swell ratio is preferably 150% to 400%. The swell ratio is calculated from the maximum swell film thickness measured under the above conditions in accordance with a relation: (maximum swell film thickness–film thickness)/film thickness.

In the light-sensitive material of the present invention, hydrophilic colloid layers (called back layers) having a total dried film thickness of 2 to 20 μm are preferably formed on the side opposite to the side having emulsion layers. The back layers preferably contain, e.g., the light absorbent, the filter dye, the ultraviolet absorbent, the antistatic agent, the film hardener, the binder, the plasticizer, the lubricant, the coating aid, and the surfactant described above. The swell ratio of the back layers is preferably 150% to 500%.

The color photographic light-sensitive material according to the present invention can be developed by conventional methods described in RD No. 17643, pp. 28 and 29, RD No. 18716, the left to right columns, page 651, and RD No. 307105, pp. 880 and 881.

A color developer used in development of the light-sensitive material of the present invention is an aqueous alkaline solution containing as a main component, preferably, an aromatic primary amine-based color developing agent. As the color developing agent, although an aminophenol-based compound is efective, a p-phenylenediamine-based compound is preferably used. Typical examples of the p-phenylenediamine-based compound are: 3-methyl-4-amino-N,N-diethylaniline, 3-methyl-4-amino-N-ethyl-N-β-hydroxyethylaniline, 3-methyl-4-amino-N-ethyl-N-β-methanesulfonamide ethylaniline, 3-methyl-4-amino-N-ethyl-N-β-methoxyethyl aniline, and the sulfates, hydrochlorides and ptoluenesulfonates thereof. Of these compounds, 3-methyl-4-amino-N-ethyl-N-β-hydroxyethyl aniline sultate is preferred in particular. These compounds can be used in a combination of two or more thereof in accordance with the application.

In general, the color developer contains a pH buffering agent such as a carbonate, a borate or a phosphate of an alkali metal, and a development restrainer or an antifoggant such as a chloride, a bromide, an iodide, a benzimidazole, a benzothiazole, or a mercapto compound. If necessary, the color developer may also contain a preservative such as hydroxylamine, diethylhydroxylamine, a sulfite a hydrazine such as N,N-biscarboxymethyl hydrazine, a phenylsemicarbazide, triethanolamine, or a catechol sulfonic acid; an organic solvent such as ethyleneglycol or diethyleneglycol; a development accelerator such as benzylalcohol, polyethyleneglycol, a quaternary ammonium salt or an amine; a dye-forming coupler; a competing coupler; an auxiliary developing agent such as 1-phenyl-3-pyrazolidone; a viscosity-imparting agent; and a chelating agent such as aminopolycarboxylic acid, an aminopolyphosphonic acid, an alkylphosphonic acid, phosphonocarboxylic acid. Examples of the chelating agent are ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N',N'-tetramethylenephosphonic acid, and ethylenediamine-di(o-hydroxyphenylacetic acid), and salts thereof.

In order to perform reversal development, black-and-white development is performed and then color development is performed. As a black-and-white developer, well-known black-and-white developing agents, e.g., a dihydroxybenzene such as hydroquinone, a 3-pyrazolidone such as 1-phenyl-3-pyrazolidone, and an aminophenol such as N-methyl-p-aminophenol can be singly or in a combination of two or more thereof.

The pH of the color and black-and-white developers is generally 9 to 12. Although the quantity of replenisher of the developer depends on a color photographic light-sensitive material to be processed, it is generally 3 liters or less per $m^2$ of the light-sensitive material. The quantity of replenisher can be decreased to be 500 ml or less by decreasing a bromide ion concentratio in a replenisher. In order to decrease the quantity of the replenisher, a contact area of a processing tank with air is preferably decreased to prevent evaporatio and oxidation of the solution upon contact with air.

The contact area of the solution with air in a processing tank can be represented by an aperture defined below:

Aperture=[contact area ($cm^2$) of processing solution with air]/[volume ($cm^3$) of the solution]

The above aperture is preferably 0.1 or less, and more preferably, 0.001 to 0.05. In order to reduce the aperture, a shielding member such as a floating cover may be provided on the surface of the photographic processing solution in the processing tank. In addition, a method of using a movable cover described in JP-A-1-82033 or a slit developing method described in JP-A-63-216050 may be used. The aperture is preferably reduced not only in color and black-and-white development steps but also in all subsequent steps, e.g., bleaching, bleach-fixing, fixing, washing, and stabilizing steps. In addition, the quantity of replenisher can be reduced by using a means of suppressing storage of bromide ions in the developing solution.

A color development time is normally 2 to 5 minutes. The processing time, however, can be shortened by setting a high temperature and a high pH and using the color developing agent at a high concentration.

The photographic emulsion layer is generally subjected to bleaching after color development. The bleaching may be performed either simultaneously with fixing (bleach-fixing) or independently thereof. In addition, in order to increase a processing speed, bleach-fixing may be performed after bleaching. Also, processing may be performed in a bleach-fixing bath having two continuous tanks, fixing may be performed before bleach-fixing, or bleaching may be performed after bleach-fixing, in accordance with the application. Examples of the bleaching agent are a compound of a multivalent metal, e.g., iron(III), peracids; quinones; and a nitro compound. Typical examples of the bleaching agent are an organic complex salt of iron(III), e.g., a complex salt with an aminopolycarboxylic acid such as ethylenediaminetetraacetic acid, diethylenetriaminepentaacetic acid, cyclohexanediaminetetraacetic acid, methyliminodiacetic acid, and 1,3-diaminopropanetetraacetic acid, and glycoletherdiaminetetraacetic acid; or a complex salt with citric acid, tartaric acid, or malic acid. Of these compounds, an iron(III) complex salt of aminopolycarboxylic acid such as an iron(III) complex salt of ethylenediaminetetraacetic acid or 1,3-diaminopropanetetraacetic acid is preferred because it can increase a processing speed and prevent an environmental contamination. The iron(III) complex salt of aminopolycarboxylic acid is useful in both the bleaching and bleach-fixing solutions. The pH of the bleaching or bleach-fixing solution using the iron(III) complex salt of aminopolycarboxylic acid is normally 4.0 to 8. In order to increase the processing speed, however, processing can be performed at a lower pH.

A bleaching accelerator can be used in the bleaching solution, the bleach-fixing solution, and their pre-bath, if necessary. Examples of a useful bleaching accelerator are: compounds having a mercapto group or a disulfide group described in, e.g., U.S. Pat. No. 3,893,858, West German Patents 1,290,812 and 2,059,988, JP-A-53-32736, JP-A-53-57831, JP-A-53-37418, JP-A-53-72623, JP-A-53-95630, JP-A-53-95631, JP-A-53-104232, JP-A-53-124424, and JP-A-53-141623, and JP-A-53-28426, and Research Disclosure No. 17129 (July, 1978); a thiazolidine derivative described in JP-A-50-140129; thiourea derivatives described in JP-B-45-8506, JP-A-52-20832, JP-A-53-32735, and U.S. Pat. No. 3,706,561; iodide salts described in West German Patent 1,127,715 and JP-A-58-16235; polyoxyethylene compounds described in West German Patents 966,410 and 2,748,430; a polyamine compound described in JP-B-45-8836; compounds described in JP-A-49-40943, JP-A-49-59644, JP-A-53-94927, JP-A-54-35727, JP-A-55-26506, and JP-A-58-163940; and a bromide ion. Of these compounds, a compound having a mercapto group or a disulfide group is preferable since the compound has a large accelerating effect. In particular, compounds described in U.S. Pat. No. 3,893,858, West German Patent 1,290,812, and JP-A-53-95630 are preferred. A compound described in U.S. Pat. No. 4,552,834 is also preferable. These bleaching accelerators may be added in the light-sensitive material. These bleaching accelerators are useful especially in bleach-fixing of a photographic color light-sensitive material.

The bleaching solution or the bleach-fixing solution preferably contains, in addition to the above compounds, an organic acid in order to prevent a bleaching stain. The most preferable organic acid is a compound having an acid dissociation constant (pKa) of 2 to 5, e.g., acetic acid, propionic acid, or hydroxy acetic acid.

Examples of the fixing agent used in the fixing solution or the bleach-fixing solution are thiosulfate, a thiocyanate, a thioether-based compound, a thiourea and a large amount of an iodide. Of these compounds, a thiosulfate, especially, ammonium thiosulfate can be used in the widest range of applications. In addition, a combination of thiosulfate and a thiocyanate, a thioether-based compound, or thiourea is preferably used. As a preservative of the fixing solution or the bleach-fixing solution, a sulfite, a bisulfite, a carbonyl bisulfite adduct, or a sulfinic acid compound described in European Patent 294,769A is preferred. In addition, in order to stabilize the fixing solution or the bleach-fixing solution, various types of aminopolycarboxylic acids or organic phosphonic acids are preferably added to the solution.

In the present invention, 0.1 to 10 mol/l of a compound having a pKa of 6.0 to 9.0 are preferably added to the fixing solution or the bleach-fixing solution in order to adjust the pH. Preferable examples of the compound are imidazoles such as imidazole, 1-methylimidazole, 1-ethylimidazole, and 2-methylimidazole.

The total time of a desilvering step is preferably as short as possible as long as no desilvering defect occurs. A preferable time is one to three minutes, and more preferably, one to two minutes. A processing temperature is 25° C. to 50° C., and preferably, 35° C. to 45° C. within the preferable temperature range, a desilvering speed is increased, and generation of a stain after the processing can be effectively prevented.

In the desilvering step, stirring is preferably as strong as possible. Examples of a method of intensifying the stirring are a method of colliding a jet stream of the processing solution against the emulsion surface of the light-sensitive material described in JP-A-62-183460, a method of increasing the stirring effect using rotating means described in JP-A-62-183461, a method of moving the light-sensitive material while the emulsion surface is brought into contact with a wiper blade provided in the solution to cause disturbance on the emulsion surface, thereby improving the stirring effect, and a method of increasing the circulating flow amount in the overall processing solution. Such a stirring improving means is effective in any of the bleaching solution, the bleach-fixing solution, and the fixing solution. It is assumed that the improvement in stirring increases the speed of supply of the bleaching agent and the fixing agent into the emulsion film to lead to an increase in desilvering speed. The above stirring improving means is more effective when the bleaching accelerator is used, i.e., significantly increases the accelerating speed or eliminates fixing interference caused by the bleaching accelerator.

An automatic developing machine for processing the light-sensitive material of the present invention preferably has a light-sensitive material conveyer means described in JP-A-60-191257, JP-A-60-191258, or JP-A-60-191259. As described in JP-A-60-191257, this conveyer means can significantly reduce carry-over of a processing solution from a pre-bath to a post-bath, thereby effectively preventing degradation in performance of the processing solution. This effect significantly shortens especially a processing time in each processing step and reduces the quantity of replenisher of a processing solution.

The photographic light-sensitive material of the present invention is normally subjected to washing and/or stabilizing steps after desilvering. An amount of water used in the washing step can be arbitrarily determined over a broad range in accordance with the properties (e.g., a property determined by the substances used, such as a coupler) of the light-sensitive material, the application of the material, the temperature of the water, the number of water tanks (the number of stages), a replenishing scheme representing a counter or forward current, and other conditions. The relationship between the amount of water and the number of water tanks in a multi-stage counter-current scheme can be obtained by a method described in "Journal of the Society of Motion Picture and Television Engineering", Vol. 64, pp. 248–253 (May, 1955).

In the multi-stage counter-current scheme disclosed in this reference, the amount of water used for washing can be greatly decreased. Since washing water stays in the tanks for a long period of time, however, bacteria multiply and the floating substances formed may be adversely attached to the light-sensitive material. In order to solve this problem in the process of the color photographic light-sensitive material of the present invention, a method of decreasing calcium and magnesium ions can be effectively utilized, as described in JP-A-62-288838. In addition, a germicide such as an isothiazolone compound and cyabendazole described in JP-A-57-8542, a chlorine-based germicide such as chlorinated sodium isocyanurate, and germicides such as benzotriazole described in Hiroshi Horiguchi et al., "Chemistry of Antibacterial and Antifungal Agents", (1986), Sankyo Shuppan, EiseigiJutsu-Kai ed., "Sterilization, Antibacterial, and Antifungal Techniques for Microorganisms", (1982), Kogyogijutsu-Kai, and Nippon Bokin Bokabi Gakkai ed., "Dictionary of Antibacterial and Antifungal Agents", (1986), can be used.

The pH of the water for washing the photographic light-sensitive material of the present invention is 4 to 9, and preferably, 5 to 8. The water temperature and the washing time can vary in accordance with the properties and applications of the light-sensitive material. Normally, the washing time is 20 seconds to 10 minutes at a temperature of 15° C. to 45° C., and preferably, 30 seconds to 5 minutes at 25° C. to 40° C. The light-sensitive material of the present invention can be processed directly by a stabilizing agent in place of washing. All known methods described in JP-A-57-8543, JP-A-58-14834, and JP-A-60-220345 can be used in such stabilizing processing.

In some cases, stabilizing is performed subsequently to washing. An example is a stabilizing bath containing a dye stabilizing agent and a surface-active agent to be used as a final bath of the photographic color light-sensitive material. Examples of the dye stabilizing agent are formalin, an aldehyde such as glutaraldehyde, an N-methylol compound, hexamethylenetetramine, and an adduct of aldehyde sulfite.

Various chelating agents and fungicides can be added to the stabilizing bath.

An overflow solution produced upon washing and/or replenishment of the stabilizing solution can be reduced in another step such as a desilvering step.

In the processing using an automatic developing machine or the like, if each processing solution described above is condensed by evaporatio, water is preferably added to correct condensation.

The silver halide color light-sensitive material of the present invention may contain a color developing agent in order to simplify processing and increases a processing speed. For this purpose, various types of precursors of a color developing agent can be preferably used. Examples of the precursor are an indoaniline-based compound described in U.S. Pat. No. 3,342,597, Schiff base compounds described in U.S. Pat. No. 3,342,599 and Research Disclosures Nos. 14,850 and 15,159, an aldol compound described in Research Disclosure No. 13,924, a metal salt complex described in U.S. Pat. No. 3,719,492, and an urethane-based compound described in JP-A-53-135628.

The silver halide color light-sensitive material of the present invention may contain various 1-phenyl-3-pyrazolidones in order to accelerate color development, if necessary. Typical examples of the compound are described in, for example, JP-A-56-64339, JP-A-57-144547, and JP-A-58-115438.

Each processing solution in the present invention is used at a temperature of 10° C. to 50° C. Although a normal processing temperature is 33° C. to 38° C., processing may be accelerated at a higher temperature to shorten a processing time, or image quality or stability of a processing solution may be improved at a lower temperature.

Further, the silver halide light-sensitive material of the present invention can be applied also to a heat-developing light-sensitive material as disclosed in, for example, U.S. Pat. No. 4,500,626, JP-A-60-133449, JP-A-59-318443, JP-A-61-238056, and European Patent 210,660A2.

The silver halide light-sensitive material of the present invention exerts its advantages more effectively when applied to a film unit equipped with a lens, which is disclosed in, for example, JP-B-2-32615 and UB-B-3-39782. (UB-B means Examined Published Japanese Utility Model Application.)

EXAMPLES

EXAMPLE 1

Emulsion A (Step a) An aqueous solution containing gelatin having an average molecular weight of 15000 (1200 ml of water, 7 g of gelatin, and 4.5 g of KBr) was poured into a reaction vessel having a volume of 4 liters. A 1.9 mole $AgNO_3$ aqueous solution and a 1.9 mole KBr aqueous solution were simultaneously added to the solution by double-jet method over 70 seconds at the rate of 25 ml/min, while stirring the solution and maintaining the solution at 30° C., thereby forming nuclei of tabular grains. Of this emulsion, a 350 ml portion was used as seed crystal. An inactive gelatin aqueous solution (containing 20 g of gelatin and 1.2 g of KBr) was added to this portion, in an amount of 650 ml, and the temperature was raised to 75° C., thereby achieving ripening for 40 minutes. Thereafter, an $AgNO_3$ aqueous solution (containing 1.7 g of $AgNO_3$) was added over 1 minute and 30 seconds. Next, 6.2 ml of an $NH_4NO_3$ (50% by weight) aqueous solution and and 6.2 ml of an $NH_3$ (25% by weight) aqueous solution were added, and the solution was ripened for 40 minutes. Then, the emulsion was adjusted to pH 7 with $HNO_3$(3N), and 1 g of KBr was added to the emulsion. Furthermore, 405 ml of 1.9 mole $AgNO_3$ aqueous solution and a KBr aqueous solution were added, while maintaining pAg at 8.3. They were added at the rate of 2.6 ml/min in the first phase of addition. The rate was gradually increased such that the final flow rate was 10 times the initial flow rate. (Step b) After lowering the temperature to 55° C., 40 ml of 0.6 mole $AgNO_3$ aqueous solution and 40 ml of 0.6 mole KBr aqueous solution were added over 10 minutes. Furthermore KBr was added, thus adjusting pAg to 8.9. Then, 157 ml of 1.9 mole $AgNO_3$ aqueous solution and 157 ml of 1.9 mole KBr aqueous solution were added over 26 minutes, thereby obtaining Emulsion A.

The method of preparing Emulsion A was based on an embodiment described in JP-A-2-838.

Emulsion A, thus obtained, was one which had an average aspect ratio of 7.0 and in which hexagonal grains having an aspect ratio exceeding 8 occupied 0% of the projected area of all grains. The variation coefficient in terms of grain size was 10%. The average grain size was 0.75 μm in equivalent-sphere diameter.

The properties of Emulsion A obtained were as is shown in Table 1.

Since $NH_3$ ripening was conducted during the forming of grains, Emulsion A has a narrow grain-size distribution and, hence, excels in monodispersibility. However, there were no hexagonal tabular grains having an aspect ratio of 8 or more.

Emulsion B

Emulsion B was prepared by performing nucleation in the same way as in the preparation of Emulsion A. After raising the temperature to 75° C., ripening was performed for 80 minutes, not adding an $AgNO_3$ aqueous solution and an $NH_4NO_3$ aqueous solution, and $NH_3$ aqueous solution as in the preparation of Emulsion A. The step of growing grains and the subsequent steps were conducted in the same way as in the preparation of Emulsion A, thereby obtaining Emulsion B.

Emulsion B, thus obtained, was one in which hexagonal tabular grains having an aspect ratio exceeding 8 occupied 68% of the projected area of all grains. However, this emulsion had a variation coefficient in terms of grain size was 29%.

The properties of Emulsion B obtained were as is shown in Table 1.

As indicated above, $NH_3$ ripening, which increases the thickness of grains, was not performed, thereby to impart a high aspect ratio to the grains. Therefore, as can be understood from the above, the ratio of grains having a high aspect ratio increased, but the grain-size distribution broadens.

Emulsion C

Emulsion C was prepared by conducing forming grains in the same way as Emulsion B, except that iodide ions were introduced into the halogen solution which was added.

Nucleation was conducted in the same manner as in the preparation of Emulsion A. After raising the temperature to 75° C., ripening was performed for 80 minutes, without adding a silver halide solvent, as in the preparation of Emulsion B.

Next, the emulsion was adjusted to pH 7.0 with $HNO_3$, and 1 g of KBr was added to the emulsion. Furthermore, 405 ml of 1.9 mole $AgNO_3$ aqueous solution and a 1.9 mole KBr aqueous solution and KI aqueous solution (mole ratio: 98/2) were added, while maintaining pAg at 8.3.

After lowering the temperature to 55° C., 40 ml of 0.6 mole $AgNO_3$ aqueous solution and 40 ml of 0.6 mole KI aqueous solution were added over 10 minutes, thereby forming a high-iodide region.

After KBr was added, thereby adjusting pAg to 8.9, 157 ml of 1.9 mole $AgNO_3$ aqueous solution and 157 ml of 1.9 mole KBr aqueous solution were added over 26 minutes, thereby obtaining Emulsion C.

Emulsion C was one in which hexagonal grains having an aspect ratio exceeding 8 occupied 26% of the projected area of all grains, and which had a variation coefficient of 34% in terms of grain size. Unlike Emulsion B, Emulsion C contains iodide ions and, therefore, had a broader grain-size distribution than Emulsion B. It is understood that a conventional method cannot form grains which has a high aspect ratio, which excels in monodispersibility and which contains a high-iodide region.

A 1.9 mole $AgNO_3$ aqueous solution and a 1.9 mole KBr aqueous solution were simultaneously added to the solution contained in a reaction vessel of the type used in preparation of Emulsion A, by double-jet method over 35 seconds at the rate of 25 ml/min. Of this emulsion, a 350 ml portion was used as seed crystal. An inactive gelatin aqueous solution (containing 20 g of gelatin and 1.2 g of KBr) was added to this portion, in an amount of 650 ml, and the temperature was raised to 75° C., thereby achieving ripening for 80 minutes. Next, the emulsion was adjusted to pH 7.0 with $HNO_3$, and 1 g of KBr was added to the emulsion. Thereafter, 405 ml of 1.9 mole $AgNO_3$ aqueous solution and a 1.9 mole KBr aqueous solution and KI aqueous solution (mole ratio: 98/2) were added, while maintaining pAg at 8.3. After lowering the temperature to 55° C., 40 ml of 0.6 mole $AgNO_3$ aqueous solution and 40 ml of 0.6 mole KI aqueous solution were added over 10 minutes. After adding KBr, thus adjusting pAg to 8.9, 157 ml of 1.9 mole $AgNO_3$ aqueous solution and 157 ml of 1.9 mole KBr aqueous solution were added over 26 minutes, thereby obtaining Emulsion D.

Emulsion D

Emulsion D was one in which hexagonal grains having an aspect ratio exceeding 8 occupied 54% of the projected area of all grains, and which had a variation coefficient of 19% in terms of grain size.

Emulsion E

Emulsion E was prepared following the same procedures as for the Emulsion D, except that nucleation was performed for 25 seconds.

Emulsion F

Emulsion F was prepared following the same procedures as for the Emulsion D, except that nucleation was performed for 10 seconds.

The properties of Emulsions C, D, E, and F obtained were as is shown in Table 1.

Emulsions C, D, E, and F were prepared following the same procedures , except for the nucleation time. It was found that, the shorter the nucleation time, the higher the possibility of forming tabular grains which has a high aspect ratio and greater monodispersibility, though containing iodide ions and having a high-iodide region.

Emulsion G

Emulsion G was prepared following the same procedures as for the Emulsion D, except that nucleation was performed at 60° C. for 35 seconds.

Emulsion H

Emulsion H was prepared following the same procedures as for the Emulsion D, except that nucleation was performed at 60° C. for 10 seconds.

The properties of Emulsions G and H obtained were as is shown in Table 1.

Comparison of Emulsions G and H reveals that, even if the nucleation is performed at 60° C. and grains contains a high-iodide region, they grain can have both a high aspect ratio and good monodispersibility, in the case that the nucleation time is short.

Emulsion I

Emulsion I was prepared by using, in nucleation, gelatin having an average molecular weight of 100.000.

An aqueous solution containing gelatin having an average molecular weight of 100.000 (1200 ml of water, 7 g of gelatin, and 4.5 g of KBr) was poured into a reaction vessel having a volume of 4 liters. A 1.9 mole $AgNO_3$ aqueous solution and a 1.9 mole KBr aqueous solution were simultaneously added to the solution by double-jet method over 10 seconds at the rate of 25 ml/min, while stirring the solution and maintaining the solution at 30° C. Of this emulsion, a 350 ml portion was used as seed crystal. An inactive gelatin aqueous solution (containing 20 g of gelatin and 1.2 g of KBr) was added to this portion, in an amount of 650 ml, and the temperature was raised to 75° C., thereby achieving ripening for 80 minutes.

Then, the emulsion was adjusted to pH 7.0 with $HNO_3$, and 1 g of KBr was added to the emulsion. Furthermore, 405 ml of 1.9 mole $AgNO_3$ aqueous solution and a 1.9 mole KBr aqueous solution were added, while maintaining pAg at 8.3. They were added at the rate of 1.4 ml/min in the first phase of addition. The rate was gradually increased such that the final flow ratio was 10 times the initial flow rate.

After lowering the temperature to 55° C., 40 ml of 0.6 mole $AgNO_3$ aqueous solution and 40 ml of 0.6 mole KBr aqueous solution were added over 10 minutes. Furthermore KBr was added, thus adjusting pAg to 8.9. Then, 157 ml of 1.9 mole $AgNO_3$ aqueous solution and 157 ml of 1.9 mole KBr aqueous solution were added over 26 minutes, thereby obtaining Emulsion I.

Emulsion J

Emulsion J was prepared by conducing nucleation and ripening in the same method as in the preparation of Emulsion I, except that iodide ions were introduced during the growth of grains.

After conducting the nucleation and ripening in the same way as in the preparation of Emulsion I, 405 ml of 1.9 mole $AgNO_3$ aqueous solution and a 1.9 mole KBr aqueous solution and KI aqueous solution (mole ratio: 98/2) were added, while maintaining pAg at 8.3. They were added at the rate of 2.6 ml/min in the first phase of addition. The rate was gradually increased such that the final flow ratio was 10 times the initial flow rate.

After lowering the temperature to 55° C., 40 ml of 0.6 mole $AgNO_3$ aqueous solution and 40 ml of 0.6 mole KBr aqueous solution were added over 10 minutes.

Furthermore KBr was added, thus adjusting pAg to 8.9. Then, 157 ml of 1.9 mole $AgNO_3$ aqueous solution and 157 ml of 1.9 mole KBr aqueous solution were added over 26 minutes, thereby obtaining Emulsion J.

Emulsion K

Emulsion K was prepared following the same procedures as for the Emulsion J, except that gelatin having an average molecular weight of 24,000 was used in an amount of 7 g in nucleation.

The properties of Emulsions I, J, and K obtained were as is shown in Table 1.

As described above, Emulsions I and J were prepared through nucleation using gelatin having an average molecular weight of 100000. It is understood that an emulsion, like Emulsion I, can have both a high aspect ratio and good monodispersibility if iodide ions are not introduced into grains, ant that an emulsion, like Emulsion J, has its grain-size distribution broadened if iodide ions are not introduced into grains.

As is evident from Table 1, Emulsion K, prepared through nucleation using gelatin having an average molecular weight of 25,000 or less, had both a high aspect ratio and good monodispersibility even though the grains contained iodide ions and had a high-iodide region.

Emulsions L and M

Emulsions L and M were prepared following the same procedures as for the Emulsion F, except that more iodide ions were introduced into the high iodide-region than in the case of Emulsion F.

The properties of Emulsions L and M obtained were as is shown in Table 1.

TABLE 1

| Emulsion No. | Nucleation temperature T(°C.) | Nucleation time t(second) | T + t | Average molecular weight of gelatins used in nucleation | Average content of silver iodide (%) | Silver iodide content in high-silver iodide region (%) |
|---|---|---|---|---|---|---|
| A | 30 | 70 | 100 | 15,000 | 0 | 0 |

TABLE 1-continued

| | | | | | | |
|---|---|---|---|---|---|---|
| B | 30 | 70 | 100 | 15,000 | 0 | 0 |
| C | 30 | 70 | 100 | 15,000 | 2.8 | 6.5 |
| D | 30 | 35 | 65 | 15,000 | 2.8 | 6.5 |
| E | 30 | 25 | 55 | 15,000 | 2.8 | 6.5 |
| F | 30 | 10 | 40 | 15,000 | 2.8 | 6.5 |
| G | 60 | 35 | 95 | 15,000 | 2.8 | 6.5 |
| H | 60 | 10 | 70 | 15,000 | 2.8 | 6.5 |
| I | 30 | 10 | 40 | 100,000 | 0 | 0 |
| J | 30 | 10 | 40 | 100,000 | 2.8 | 6.5 |
| K | 30 | 10 | 40 | 24,000 | 2.8 | 6.5 |
| L | 30 | 10 | 40 | 15,000 | 3.2 | 9.2 |
| M | 30 | 10 | 40 | 15,000 | 4.0 | 12.5 |

| Emulsion No. | Average aspect ratio | Projected area ratio of hexagonal tabular grains having an aspect ratio 8 or more (%) | Projected area ratio of hexagonal tabular grains having an aspect ratio of 12 or more (%) | Variation coefficient in terms of grain size (%) | Equivalent-sphere diameter (μm) | |
|---|---|---|---|---|---|---|
| A | 5.2 | 0 | 0 | 10 | 0.75 | Comparative example |
| B | 9.0 | 68 | 25 | 29 | 0.61 | Comparative example |
| C | 7.5 | 26 | 8 | 34 | 0.61 | Comparative example |
| D | 9.0 | 54 | 10 | 19 | 0.72 | Present invention |
| E | 13.0 | 86 | 67 | 17 | 0.80 | Present invention |
| F | 23.0 | 97 | 97 | 12 | 1.10 | Present invention |
| G | 19.0 | 92 | 90 | 28 | 0.91 | Comparative example |
| H | 25.0 | 96 | 96 | 19 | 1.15 | Present invention |
| I | 22.0 | 94 | 94 | 17 | 1.10 | Comparative example |
| J | 20.0 | 92 | 86 | 23 | 1.10 | Comparative example |
| K | 21.5 | 92 | 92 | 16 | 1.10 | Present invention |
| L | 22.0 | 97 | 97 | 13 | 1.10 | Present invention |
| M | 21.0 | 97 | 97 | 15 | 1.10 | Present invention |

As is evident from Table 1, the method according to the present invention can form emulsion grains contain a high-iodide region and and have a high aspect ratio and high monodispersibility, even if they have a high iodide content.

EXAMPLE 2

Emulsions A to M were subjected to chemical sensitization at 60° C., pH 6.20 and pAg 8.40, as will be described below.

First, the sensitizing dye presented later in an amount of 1.0 to $2.0\times10^{31\ 3}$ mole per mole silver.

Then, $3.0\times10^{-3}$ mole of potassium thiocyanate, $4\times10^{-6}$ to $8\times10^{-6}$ mole of potassium chloroaurate, $1\times10^{-5}$ to $2\times10^{-5}$ mole of sodium thiocyanate, and $2\times10^{-6}$ to $4\times10^{-6}$ mole of the selenium sensitizer presented later were added per mole of silver. The conditions of chemical sensitization were adjusted such that each emulsion might have a highest sensitivity at 1/100-second exposure.

After the chemical sensitization, the compounds specified below were added to the emulsions. The emulsions were coated, along with a protective layer, on an undercoated triacetylcellulose film support by means of co-extrusion method, thereby forming Samples 101 to 113.

(1) Emulsion layer

Emulsion: Emulsions A to M

Compound 1 presented later

Tricresylphosphate

Stabilizer: 4-hydroxy-6-methyl-1,3,3a,7-tetraazaindine

Coating aid: sodium dodecylbenzenesulfonate (2) Protective layer

Fine grains of polymethylmethacrylate 2,4-dichloro-6-hydroxy-s-triazine sodium salt These samples were subjected to sensitometry exposure (1/100 second), and hence to the following color development.

The color development was performed at 38° C. under the following conditions:

| | |
|---|---|
| 1. Color Development | 2 min. 45 sec. |
| 2. Bleaching | 6 min. 30 sec. |
| 3. Washing | 3 min. 15 sec. |
| 4. Fixing | 6 min. 30 sec. |
| 5. Washing | 3 min. 15 sec. |
| 6. Stabilization | 3 min. 15 sec. |

The compositions of the solutions used in the process are as follows:

| | |
|---|---|
| (Color developing solution): | |
| Sodium nitrilotriacetate | 1.0 g |
| Sodium sulfite | 4.0 g |
| Sodium carbonate | 30.0 g |
| Potassium bromide | 1.4 g |
| Hydroxylamine sulfate | 2.4 g |
| 4-[N-ethyl-N-β-hydroxyl-ethylamino]-2-methyl-aniline sulfate | 4.5 g |
| water to make | 1 litter |
| (Bleaching solution): | |
| Ammonium bromide | 160.0 g |
| Ammonia water (28%) | 25.0 ml |
| Sodium ethylenediamine tetraacetate | 130 g |
| Glacial acetic acid | 14 ml |
| Water to make | 1 litter |
| (Fixing solution): | |
| Sodium tetrapolyphosphate | 2.0 g |
| Sodium sulfite | 4.0 g |
| Ammonium thiosulfate (70%) | 175.0 ml |
| Sodium bissulfite | 4.6 g |
| Water to make | 1 litter |
| (Stabilizing solution): | |
| Formalin | 8.0 ml |
| Water to make | 1 litter |

The samples 101 to 113, thus processed, were tested for their densities by means of a green filter.

The sensitivity of each sample was represented by the reciprocal of the exposure amount at which a density of fog+0.2 is given, and was presented in a relative value, using as reference the sensitivity of Sample 101 which was "100."

RMS granularity value of each sample was measured by exposing uniformly the sample to an amount of light at which a density of fog+0.2 is given, then by developing the sample as described above, and finally be using a G filter in the method disclosed in "The Theory of the Photographic Process," Macmillan, p. 618.

The results were as is shown in Table 2.

Sensitizing dye

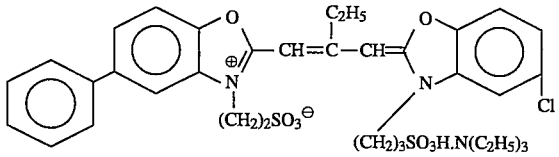

Selenium sensitizing dye

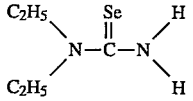

Compound 1

-continued

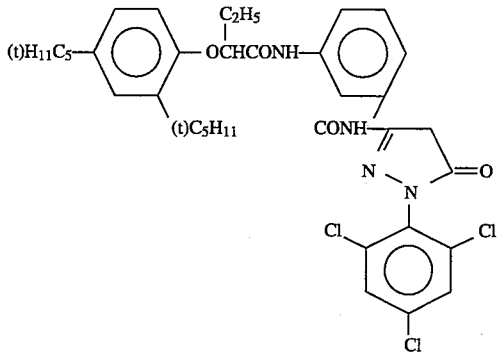

TABLE 2

| Emulsion | Sample No. | Sensitivity | RMS granularity | |
|---|---|---|---|---|
| A | 101 | 100 | 0.020 | Comparative example |
| B | 102 | 85 | 0.020 | Comparative example |
| C | 103 | 94 | 0.017 | Comparative example |
| D | 104 | 220 | 0.016 | Present invention |
| E | 105 | 280 | 0.017 | Present invention |
| F | 106 | 350 | 0.020 | Present invention |
| G | 107 | 280 | 0.030 | Comparative example |
| H | 108 | 350 | 0.027 | Present invention |
| I | 109 | 270 | 0.032 | Comparative example |
| J | 110 | 250 | 0.026 | Comparative example |
| K | 111 | 330 | 0.022 | Present invention |
| L | 112 | 340 | 0.018 | Present invention |
| M | 113 | 320 | 0.016 | Present invention |

As can be seen from Table 2, the emulsions of the present invention can have remarkably high sensitivity, not at expense of their graininess. Although it is generally difficult for an emulsion to have both high sensitivity and great graininess, the emulsions of the present invention, which have a high aspect ratio and contain a high-iodide region, have sensitivity and graininess which the inventors could not expect.

EXAMPLE 3

A plurality of layers having the following compositions were coated on undercoated triacetylcellulose film supports, forming Samples 201 to 209 of multi-layered color light-sensitive materials.

(Compositions of light-sensitive layers)

Main components used in each of the layers are classified into the following:

ExC: Cyan coupler

ExM: Magenta coupler

ExY: Yellow coupler

ExS: Sensitizing dye

UV: Ultraviolet-ray absorbent

HBS: High-boiling organic solvent

H: Gelatin-hardening agent

Numerals corresponding to each component indicates a coating amount represented in units of $g/m^2$. The coating amount of a silver halide is represented by the coating amount of silver. The coating amount of a sensitizing dye is represented in units of moles per mole of a silver halide in the same layer.

| (Samples 201 to 209) | |
|---|---|
| Layer 1 (Antihalation layer) | |
| Black colloidal silver | silver 0.18 |
| Gelatin | 1.40 |
| ExM-1 | 0.18 |
| ExF-1 | $2.0 \times 10^{-3}$ |
| HBS-1 | 0.20 |
| Layer 2 (Interlayer) | |
| Emulsion g | Silver 0.065 |
| 2,5-di-t-pentadecylhydorquinone | 0.18 |
| ExC-2 | 0.020 |
| UV-1 | 0.060 |
| UV-2 | 0.080 |
| UV-3 | 0.10 |
| HBS-1 | 0.10 |
| HBS-2 | 0.020 |
| Gelatin | 1.04 |
| Layer 3 (Low-speed red-sensitive emulsion layer) | |
| Emulsion a | silver 0.25 |
| Emulsion c | silver 0.25 |
| ExS-1 | $4.5 \times 10^{-4}$ |
| ExS-2 | $1.5 \times 10^{-5}$ |
| ExS-3 | $4.5 \times 10^{-4}$ |
| ExC-1 | 0.17 |
| ExC-3 | 0.030 |
| ExC-4 | 0.10 |
| ExC-5 | 0.0050 |
| ExC-7 | 0.0050 |
| ExC-8 | 0.020 |
| Cpd-2 | 0.025 |
| HBS-1 | 0.10 |
| Gelatin | 0.87 |
| Layer 4 (Medium-speed red-sensitive emulsion layer) | |
| Emulsion d | silver 0.80 |
| ExS-1 | $3.0 \times 10^{-4}$ |
| ExS-2 | $1.2 \times 10^{-5}$ |
| ExS-3 | $4.0 \times 10^{-4}$ |
| ExC-1 | 0.15 |
| ExC-2 | 0.060 |
| ExC-4 | 0.11 |
| ExC-7 | 0.0010 |
| ExC-8 | 0.025 |
| Cpd-2 | 0.023 |
| HBS-1 | 0.10 |
| Gelatin | 0.75 |
| Layer 5 (High-speed red-sensitive emulsion layer) | |
| Emulsion (one of Emulsions Silver A, B, C, F, I, J, K, L and M represented by Table 1, prepared in Example 1) | silver 1.40 |
| ExS-1 | $2.0 \times 10^{-4}$ |
| ExS-2 | $1.0 \times 10^{-5}$ |
| ExS-3 | $3.0 \times 10^{-4}$ |
| ExC-1 | 0.095 |

-continued

| (Samples 201 to 209) | |
|---|---|
| ExC-3 | 0.040 |
| ExC-6 | 0.020 |
| ExC-8 | 0.007 |
| Cpd-2 | 0.050 |
| HBS-1 | 0.22 |
| HBS-2 | 0.10 |
| Gelatin | 1.20 |
| Layer 6 (Interlayer) | |
| Cpd-1 | 0.10 |
| HBS-1 | 0.50 |
| Gelatin | 1.10 |
| Layer 7 (Low-speed green-sensitive emulsion layer) | |
| Emulsion a | silver 0.17 |
| Emulsion b | silver 0.17 |
| ExS-4 | $4.0 \times 10^{-5}$ |
| ExS-5 | $1.8 \times 10^{-4}$ |
| ExS-6 | $6.5 \times 10^{-4}$ |
| ExM-1 | 0.010 |
| ExM-2 | 0.33 |
| ExM-3 | 0.086 |
| ExY-1 | 0.015 |
| HBS-1 | 0.30 |
| HBS-3 | 0.010 |
| Gelatin | 0.73 |
| Layer 8 (Medium-speed green-sensitive emulsion layer) | |
| Emulsion d | silver 0.80 |
| ExS-4 | $2.0 \times 10^{-5}$ |
| ExS-5 | $1.4 \times 10^{-4}$ |
| ExS-6 | $5.4 \times 10^{-4}$ |
| ExM-2 | 0.16 |
| ExM-3 | 0.045 |
| ExY-1 | 0.01 |
| ExY-5 | 0.030 |
| HBS-1 | 0.16 |
| HBS-3 | $8.0 \times 10^{-3}$ |
| Gelatin | 0.90 |
| Layer 9 (High-speed green-sensitive emulsion layer) | |
| Emulsion e | silver 1.25 |
| ExS-4 | $3.7 \times 10^{-5}$ |
| ExS-5 | $8.1 \times 10^{-5}$ |
| ExS-6 | $3.2 \times 10^{-4}$ |
| ExC-1 | 0.010 |
| ExM-1 | 0.015 |
| ExM-4 | 0.040 |
| ExM-5 | 0.019 |
| Cpd-3 | 0.020 |
| HBS-1 | 0.25 |
| HBS-2 | 0.10 |
| Gelatin | 1.20 |
| Layer 10 (Yellow filter layer) | |
| Yellow colloid silver | Silver 0.010 |
| Cpd-1 | 0.16 |
| HBS-1 | 0.60 |
| Gelatin | 0.60 |
| Layer 11 (Low-speed blue-sensitive emulsion layer) | |
| Emulsion c | silver 0.25 |
| Emulsion d | silver 0.40 |
| ExS-7 | $8.0 \times 10^{-4}$ |
| ExY-1 | 0.030 |
| ExY-2 | 0.55 |
| ExY-3 | 0.25 |
| ExY-4 | 0.020 |
| ExC-7 | 0.01 |
| HBS-1 | 0.35 |
| Gelatin | 1.30 |
| Layer 12 (High-speed blue-sensitive emulsion layer) | |
| Emulsion f | silver 1.38 |
| ExS-7 | $3.0 \times 10^{-4}$ |
| ExY-2 | 0.10 |

-continued

| (Samples 201 to 209) | |
|---|---|
| ExY-3 | 0.10 |
| HBS-1 | 0.070 |
| Gelatin | 0.86 |
| Layer 13 (First protective layer) | |
| Emulsion g | silver 0.20 |
| UV-4 | 0.11 |
| UV-5 | 0.17 |
| HBS-1 | $5.0 \times 10^{-2}$ |
| Gelatin | 1.00 |
| Layer 14 (Second protective layer) | |
| H-1 | 0.40 |
| B-1 (diameter: 1.7 μm) | $5.0 \times 10^{-2}$ |
| B-2 (diameter: 1.7 μm) | 0.10 |
| B-3 | 0.10 |
| S-1 | 0.20 |
| Gelatin | 1.20 |

Further, all layers of the samples contained w-1 to W-3, B-4 to B-6, F-1 to F-17, iron salt, lead salt, gold salt, platinum salt, iridium salt, palladium salt, and rohdium salt, so that they may have improved storage stability, may be more readily processed, may be more resistant to pressure, more antibacterial and more anti-fungal, may be better protected against electrical charging, and may be more readily coated. The emulsions a to g, which were used in the samples, will be specified in Table 3.

TABLE 3

| | Average AgI content (%) | Average grain diameter (μm) | Variation coefficient in terms of grain size (%) | Diameter/ thickness | Silver ratio [core/intermediate/ shell] (AgI content) | Grain structure/shape |
|---|---|---|---|---|---|---|
| Emulsion a | 1.5 | 0.30 | 10 | 1 | [1/1](1/2) | Double structure, cubic grains |
| b | 1.5 | 0.50 | 8 | 1 | [1/1] (1/2) | Double structure, cubic grains |
| c | 3.0 | 0.45 | 25 | 7 | [10/60/30](0/1/8) | Triple structure, tabular grains |
| d | 2.8 | 0.80 | 18 | 6 | [14/56/30](0.2/1/7.5) | Triple structure, tabular grains |
| e | 2.3 | 1.10 | 16 | 6 | [6/64/30](0.2/1/5.5) | Triple structure, tabular grains |
| f | 13.6 | 1.75 | 26 | 3 | [1/2](41/0) | Double structure, plate-like grains |
| g | 1.0 | 0.07 | 15 | 1 | — | Uniform, fine grains |

(1) Emulsions a to f were subjected to reduction sensitization during grain preparation by using thiourea dioxide and thiosulfonic acid in accordance with the examples in JP-A-2-191938.

(2) Emulsions a to f were subjected to gold sensitization, sulfur sensitization and selenium sensitization in the presence of the specified spectral sensitizing dyes described in the individual light-sensitive layers and sodium thiocyanate in accordance with the examples in JP-A-3-23740.

(3) In the preparation of tabular grains, low-molecular gelatin is used in accordance with the examples in JP-A-1-158426.

(4) In the tabular grains, there were observed such dislocation lines as are described in JP-A-3-237450, by means of a high-voltage electron microscope.

Samples 201 to 209 were prepared by using any one of Emulsions A, B, C, F, I, J, K, L, and M prepared in Example 1, as emulsion for the fifth layer (the high-speed red-sensitive emulsion layer).

The color photographic light-sensitive materials described above were processed, after having been exposed, by the method described in Example 2.

The compounds used in forming the layers of the samples are specified below:

ExC-1
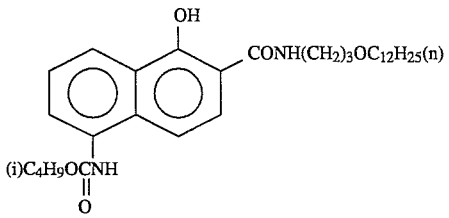
ExC-2
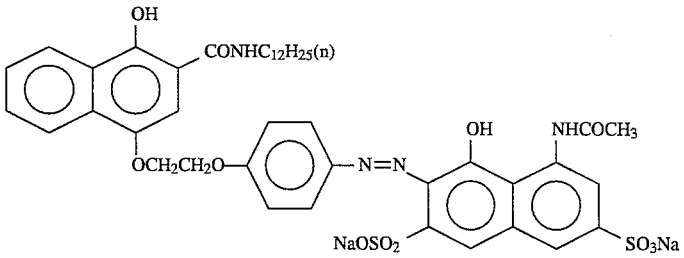
ExC-3
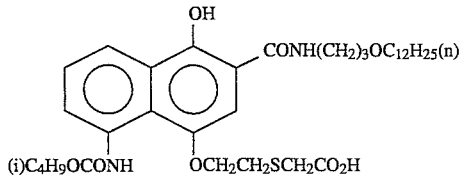
ExC-4
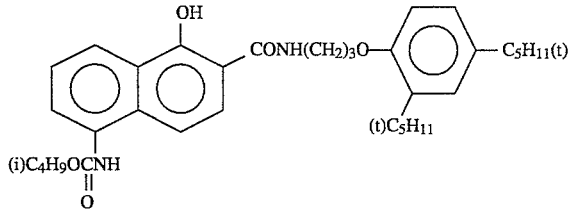
ExC-5
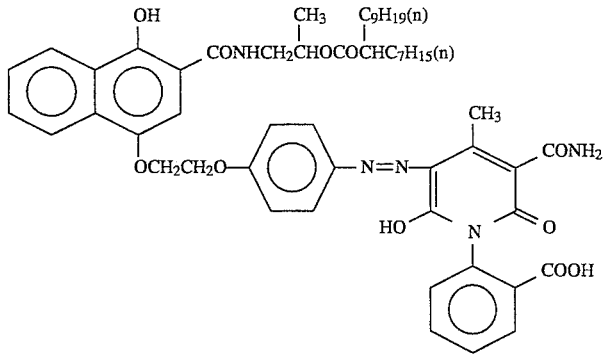
ExC-6
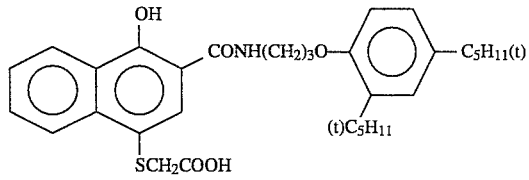

-continued
ExC-7
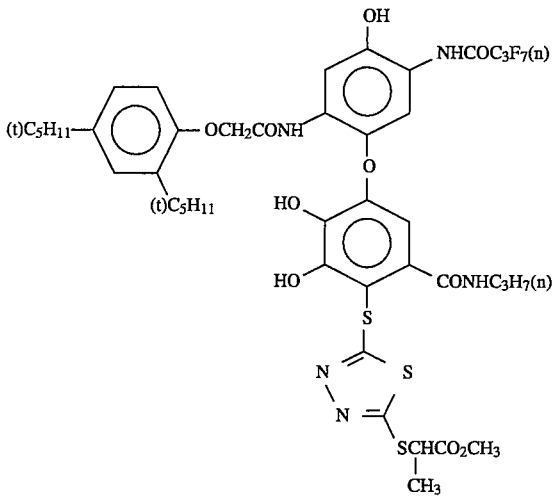
ExC-8
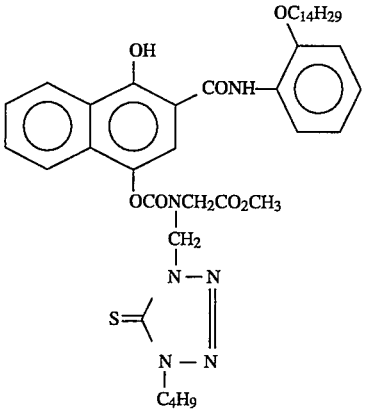
ExM-1
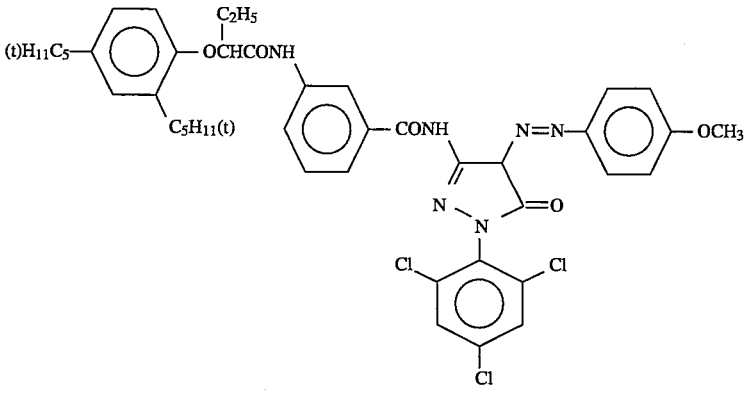

-continued
ExM-2
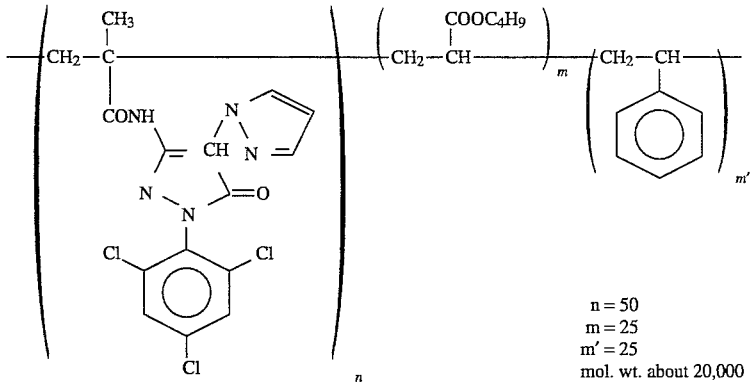
ExM-3
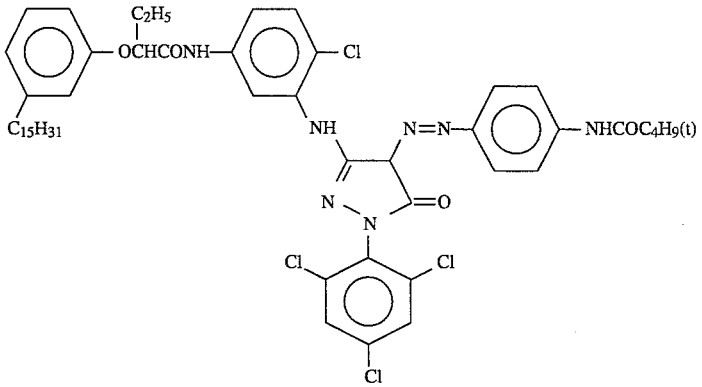
ExM-4
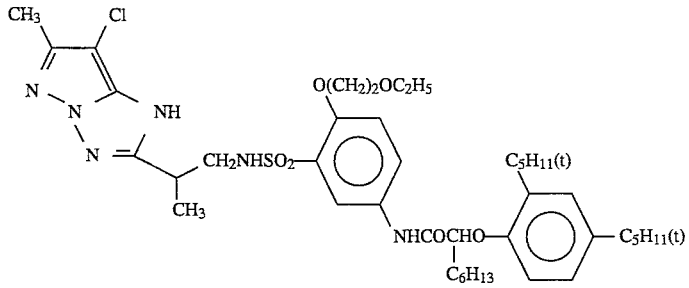
ExM-5
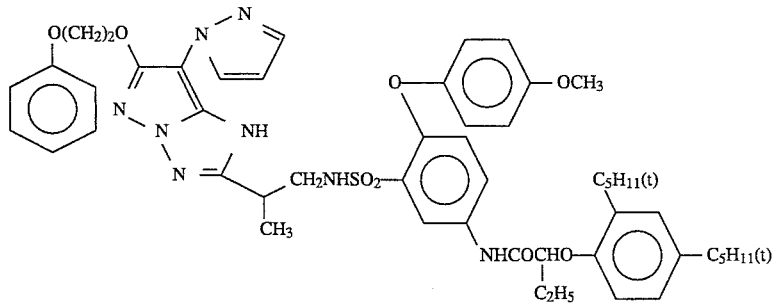

-continued
ExY-1
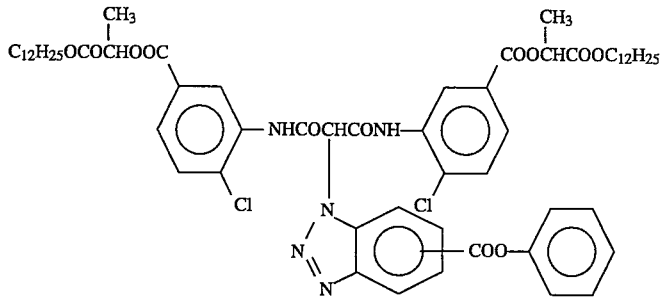
ExY-2
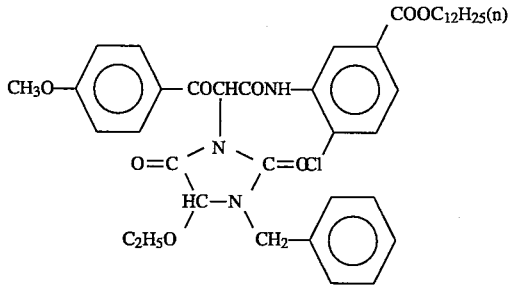
ExY-3
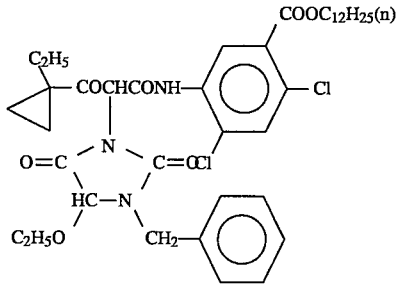
ExY-4
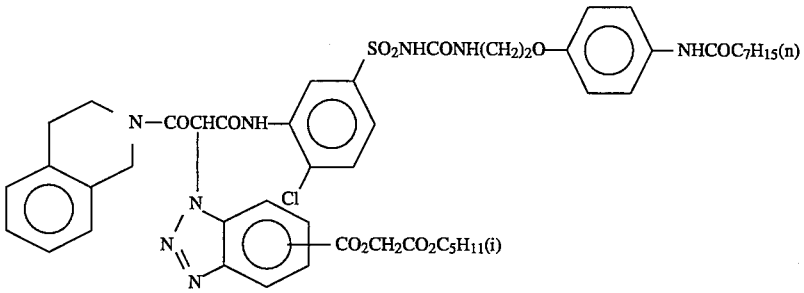
ExY-5
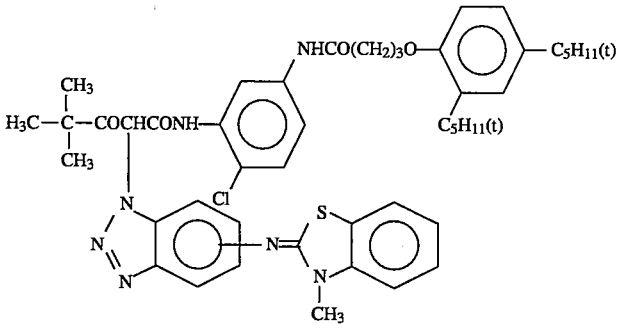

-continued
ExF-1
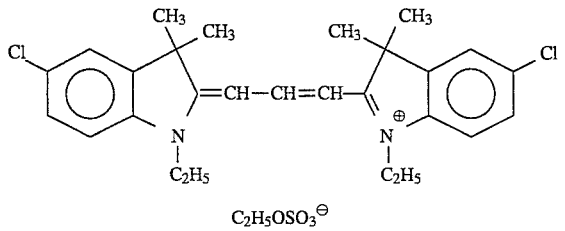
Cpd-1
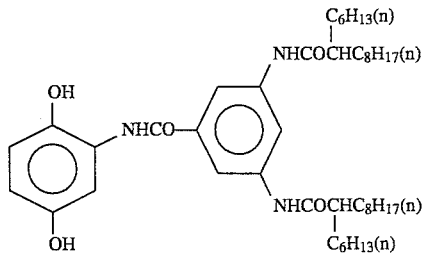
Cpd-2
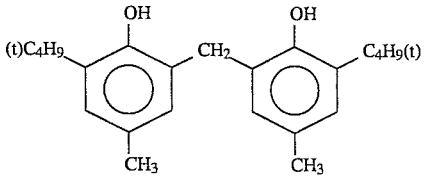
Cpd-3
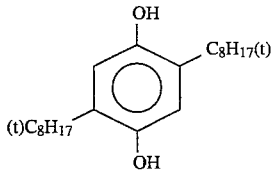
UV-1
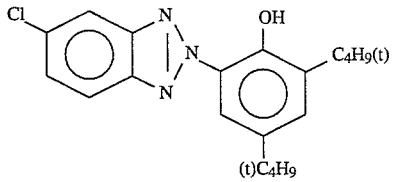
UV-2
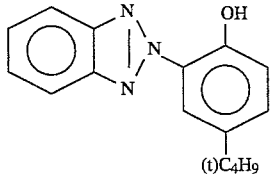
UV-3
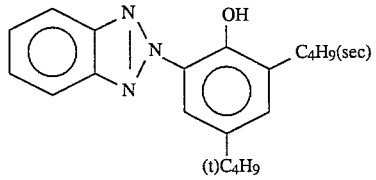
UV-4
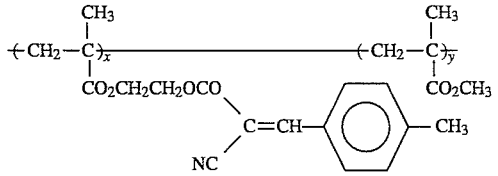
x:y = 70:30(wt %)

-continued
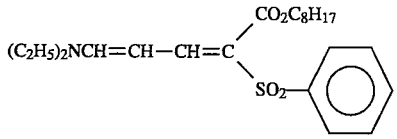
UV-5
Tricresylphosphate
HBS-1
Di-n-butylphthalate
HBS-2
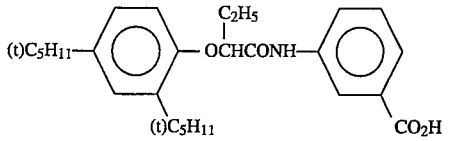
HBS-3
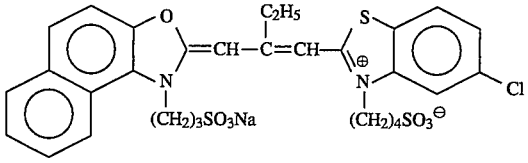
ExS-1
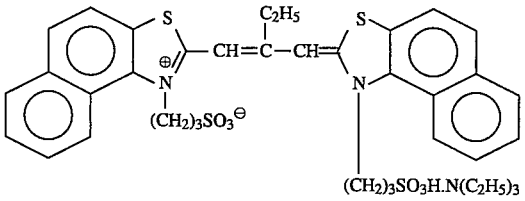
ExS-2
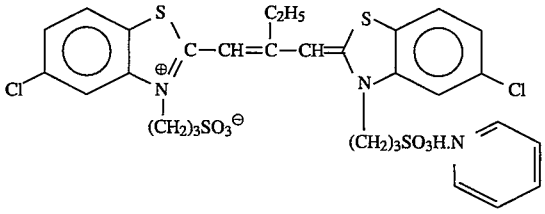
ExS-3
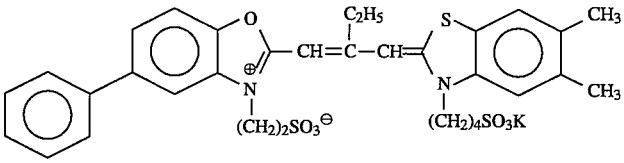
ExS-4
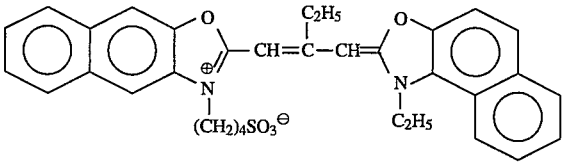
ExS-5
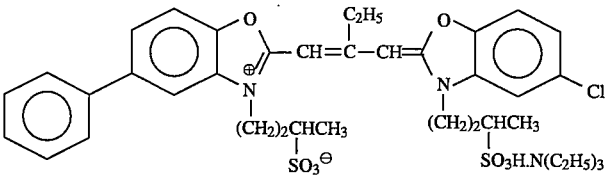
ExS-6

-continued
ExS-7
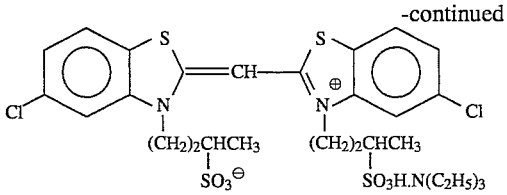
S-1
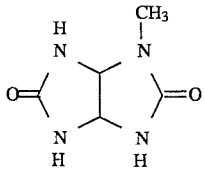
H-1
$CH_2{=}CH{-}SO_2{-}CH_2{-}CONH{-}CH_2$
$CH_2{=}CH{-}SO_2{-}CH_2{-}CONH{-}CH_2$
B-1
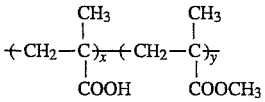
x/y = 10/90
B-2
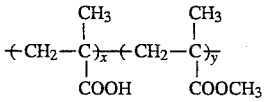
x/y = 40/60
B-3
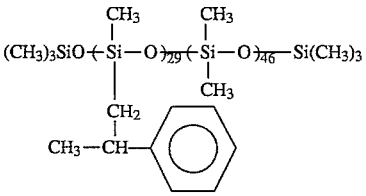
B-4
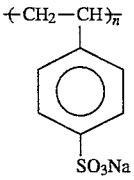
B-5
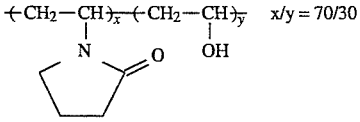
x/y = 70/30
B-6
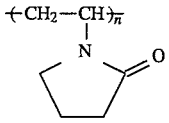
(mol.wt. about 10,000)
W-1
$C_8F_{17}SO_2NHCH_2CH_2CH_2OCH_2CH_2\overset{\ominus}{N}(CH_3)_3$
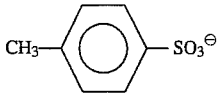
W-2
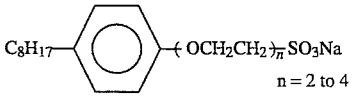
n = 2 to 4

-continued
W-3
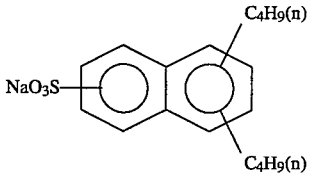
F-1
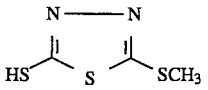
F-2
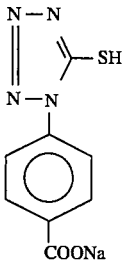
F-3
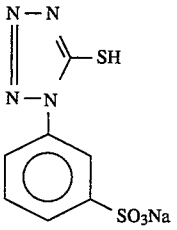
F-4
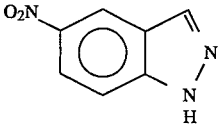
F-5
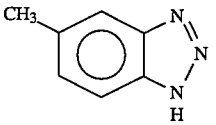
F-6
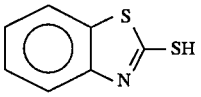
F-7
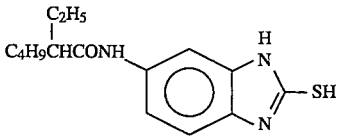
F-8
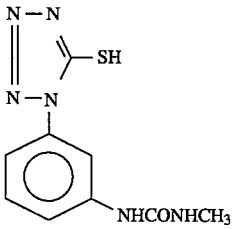
F-9
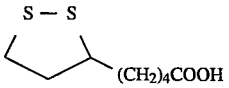

-continued

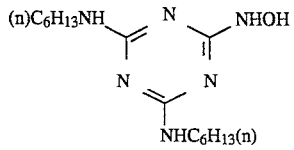

F-10

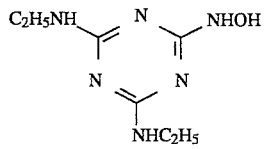

F-11

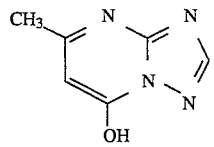

F-12

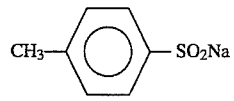

F-13

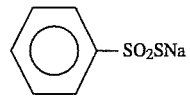

F-14

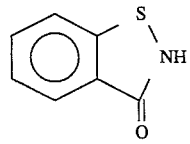

F-15

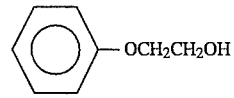

F-16

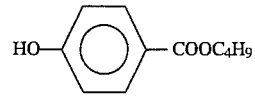

F-17

The sensitivity of each sample was represented by the reciprocal of the exposure amount at which a density of fog+0.2 is given, on the characteristic curve of a cyan image, and was measured in a relative value, using as reference the sensitivity of Sample 201 which was "100." Gradient and RMS granularity value of each sample were defined in the same manner as in Example 3.

The results were as is shown in Table 4.

TABLE 4

| Sample No. | Emulsion in 5th layer | Sensitivity | RMS granularity | |
|---|---|---|---|---|
| 201 | A | 100 | 0.020 | Comparative example |
| 202 | B | 84 | 0.020 | Comparative example |
| 203 | C | 95 | 0.015 | Comparative example |
| 204 | F | 348 | 0.021 | Present invention |
| 205 | I | 239 | 0.034 | Comparative example |

TABLE 4-continued

| Sample No. | Emulsion in 5th layer | Sensitivity | RMS granularity | |
|---|---|---|---|---|
| 206 | J | 210 | 0.020 | Comparative example |
| 207 | K | 322 | 0.020 | Present invention |
| 208 | L | 329 | 0.019 | Present invention |
| 209 | M | 310 | 0.018 | Present invention |

As is evident from Table 4, the emulsions of the present invention had high sensitivity and good graininess. In particular, the emulsions containing a high-iodide region excelled in both sensitivity and graininess and to exhibit excellent properties when used as color negative light-sensitive materials.

What is claimed is:

1. A process for producing a silver halide emulsion, which comprises:

(1) reacting silver ions and halide ions by combining a silver nitrate aqueous solution with a halide salt aqueous solution in a vessel in the presence of a low-molecular weight gelatin having a molecular weight in the range of 5,000 to 25,000, so as to form tabular silver halide grain nuclei; said reaction being carried out at a temperature T in the range of 20 to 45° C. and said nuclei formation being completed within time t (seconds) after the combining of said solutions begins, wherein said time t satisfies the relationship $1<t<-T+60$; and (2) growing said grain nuclei in said vessel to form a silver halide emulsion having a grain size variation coefficient of 8% to 20% and wherein 50% to 100% of said silver halide grains, based on projected area, are hexagonal tabular silver halide grains which have an aspect ratio of 8 to 40, an average silver iodide content of 2 mol % to 10 mol %, and a ratio of the longest side to the shortest side of the grain of 1:1 to 2:1.

2. The process according to claim 1, wherein the hexagonal silver halide grains contain a high-silver iodide region containing 6 mol % to 20 mol % of silver iodide.

3. The process according to claim 1 wherein 50% to 100% of the silver halide grains, based on projected area, are hexagonal tabular silver halide grains having an aspect ratio of 12 to 40.

4. The process according to claim 1, wherein non-tabular grain nuclei are not eliminated after nucleation by the addition of a silver halide solvent.

5. The process according to claim 1, which further comprises conducting Ostwald ripening after said nuclei have been formed.

6. The process according to claim 1, wherein said grain growing comprises adding to said vessel a source of silver ions and a halide solution.

7. The process according to claim 6, wherein said source of silver ions is added in the form of fine grains of silver halide.

8. The process according to claim 1, wherein said low-molecular weight gelatin has a molecular weight in the range of 5,000 to 20.000.

9. The process according to claim 8, wherein said low-molecular weight gelatin has a molecular weight in the range of 5,000 to 18,000.

10. The process according to claim 1, wherein said time t satisfies the relationship $1<t<-T+50$.

* * * * *